United States Patent [19]

Mihayashi et al.

[11] Patent Number: 4,656,123

[45] Date of Patent: Apr. 7, 1987

[54] SILVER HALIDE LIGHT-SENSITIVE MATERIAL COMPRISING A FOGGANT-RELEASING COUPLER AND A NON-DEVELOPABLE SILVER HALIDE LAYER BETWEEN COLOR-SENSITIVE EMULSION LAYERS

[75] Inventors: Keiji Mihayashi; Hidetoshi Kobayashi, both of Kanagawa, Japan

[73] Assignee: Fuji Photo Film Co., Ltd., Kanagawa, Japan

[21] Appl. No.: 695,132

[22] Filed: Jan. 25, 1985

[30] Foreign Application Priority Data

Jan. 25, 1984 [JP] Japan ..... 59-11745

[51] Int. Cl.[4] ..... G03C 1/46; G03C 1/00; G03C 1/08; G03C 7/32

[52] U.S. Cl. ..... 430/543; 430/505; 430/598; 430/955

[58] Field of Search ..... 430/598, 955, 505, 543

[56] References Cited

U.S. PATENT DOCUMENTS 4,358,528 11/1982 Takagi et al. ..... 430/598
4,518,682 5/1985 Kobayashi et al. ..... 430/543
4,526,863 7/1985 Mihayashi et al. ..... 430/543

FOREIGN PATENT DOCUMENTS 0117511 9/1984 European Pat. Off. ..... 430/598
0127081 12/1984 European Pat. Off. ..... 430/598
2131188 6/1984 United Kingdom .

*Primary Examiner*—John E. Kittle
*Assistant Examiner*—Mukund J. Shah
*Attorney, Agent, or Firm*—Sughrue, Mion, Zinn, Macpeak and Seas

[57] ABSTRACT

A silver halide light-sensitive material is described, comprising a support having provided thereon at least two silver halide emulsion layers differing in color sensitivity, wherein at least one of said layers contains at least one compound capable of releasing a fogging agent, a development accelerator, or a precursor thereof in proportion to the amount of silver developed, and a layer containing silver halide grains which are not substantially developed by the development processing of said material is provided between said two emulsion layers differing in color sensitivity. The material has improved color reproducibility.

19 Claims, 1 Drawing Figure

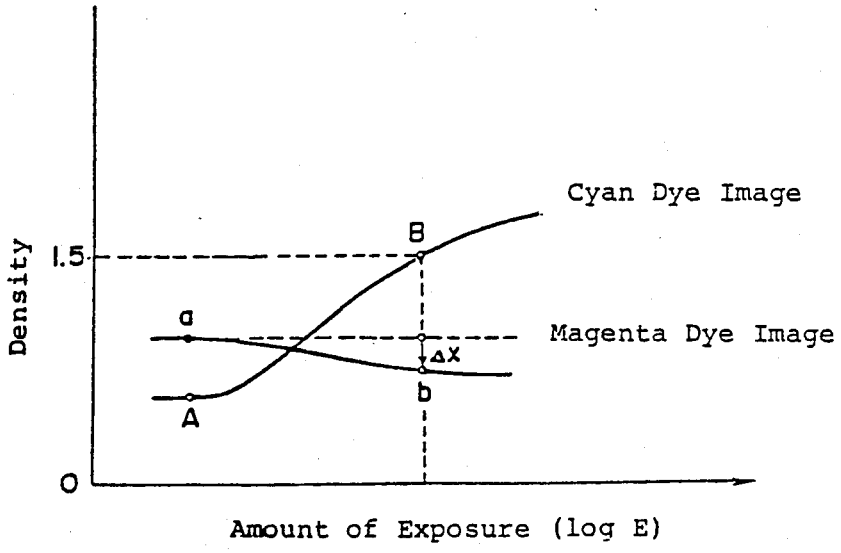
Cyan Dye Image
B
1.5
Density
a
Magenta Dye Image
ΔX
b
A
0
Amount of Exposure (log E)

SILVER HALIDE LIGHT-SENSITIVE MATERIAL COMPRISING A FOGGANT-RELEASING COUPLER AND A NON-DEVELOPABLE SILVER HALIDE LAYER BETWEEN COLOR-SENSITIVE EMULSION LAYERS

FIELD OF THE INVENTION

This invention relates to a silver halide light-sensitive material containing a compound capable of imagewise releasing a fogging agent or a development accelerator or a precursor thereof to thereby increase sensitivity and contrast or to accelerate development. More particularly, this invention relates to a silver halide color photographic light-sensitive material having improved color reproducibility.

BACKGROUND OF THE INVENTION

With recent developments in silver halide photographic light-sensitive materials, particularly light-sensitive materials for photography, light-sensitive materials having high sensitivity, as typically exemplified by films of ISO 1000, have become strongly desired. Various methods to increase sensitivity have hitherto been attempted by, for example, increasing the size of the silver halide grains increasing activity of couplers, accelerating development, and the like. However, any further increase in sensitivity by using large-sized silver halide grains cannot be expected, seeing that achievement in increasing sensitivity by using large-sized silver halide grains seems to have reached the limitation as reported in G. C. Farnell and J. B. Chanter, *Journal of Photographic Science,* Vol. 9, 75 (1961). Furthermore, increasing the grain size is accompanied with various disadvantages, such as deterioration in improved graininess or preservability of an emulsion layer in projection to increasing thickness. Further, use of highly active couplers or acceleration of development is not only accompanied by significant deterioration in graininess, but such is also insufficient in contributing to increases in sensitivity. Furthermore, addition of various development accelerators, such as hydrazine compounds, to an emulsion layer or a developing solution, typically in achromatic light-sensitive materials, has been studied for the purpose of accelerating development. However, conventional development accelerators are not fully satisfactory due to a tendency to increase fog and/or deteriorate graininess.

Hence, couplers capable of imagewise releasing a development accelerator or a fogging agent have been proposed. For example, U.S. Pat. Nos. 3,214,377 and 3,253,924 and Japanese Patent Application (OPI) No. 17437/76 (the term "OPI" as used herein means an "unexamined published application") disclose couplers capable of releasing thiocyanate ions which accelerate a physical phenomenon of dissolution. Further, Japanese Patent Application (OPI) No. 138636/82 discloses couplers capable of releasing hydroquinone or aminophenol developing agents.

However, the groups released from these couplers exhibit insufficient development accelerating activity or fogging activity so that use of these couplers brings about only a little effect. In order to overcome this problem, couplers capable of releasing acylhydrazines as described in Japanese Patent Application (OPI) No. 150845/72 and couplers capable of releasing thiocarbonyl compounds as described in Japanese Patent Application (OPI) No. 161515/82 have been proposed to realize increase of sensitivity of means of couplers.

Nevertheless, since the released groups from these couplers are highly diffusible, when the couplers are incorporated in a layer sensitive to a certain color, the released compound is also diffused into other layers sensitive to a different color to thereby exhibit development accelerating activity or fogging activity therein, thus causing color mixing. Therefore, use of these couplers turns out to be disadvantageous in that color reproducibility is extremely deteriorated.

More specifically, in light-sensitive materials containing a compound capable of imagewise releasing of a fogging agent or a development accelerator or a precursor thereof (hereinafter referred to as "FR compound", and the compound capable of releasing FR compounds is hereinafter referred to as "FR-releasing compound") in accordance with the amount of developed silver, the FR compound released upon development donates an electron to the silver halide in the light-sensitive material or forms silver sulfide to increase centers of development, and thus accelerates development. As a result, favorable effects, such as an increase in sensitivity, increase in contrast, acceleration of development, and the like can be attained. On the other hand, a part of the FR compound imagewise released in a layer having a certain color sensitivity diffuses into other layers having different color sensitivity and accelerates development imagewise of said color sensitivity over unnecessarily enlarged portions of the light-sensitive material. This results in significant color mixing and extreme deterioration of color reproducibility Various other additives have also been studied in to increase sensitivity, but did not succeed due to considerable side effects.

SUMMARY OF THE INVENTION

One object of this invention is to provide a silver halide photographic light-sensitive material having high sensitivity and excellent color reproducibility.

Another object of this invention is to provide a silver halide photographic light-sensitive material which is excellent in rate of development and color reproducibility.

A further object of this invention is to provide a silver halide photographic light-sensitive material which exhibits improved color reproducibility while containing a reduced amount of silver.

As a result of extensive investigations to prevent diffusion of an FR compound from a particular color-sensitive emulsion layer in which the FR compound would be expected to act in other emulsion layers having a different color sensitivity, the present invention has finally been accomplished.

Thus, the objects of this invention can be accomplished by a silver halide photographic light-sensitive material comprising a support having provided thereon at least two emulsion layers differing in color sensitivity, at least one of said emulsion layers containing at least one compound capable of releasing a fogging agent, a development accelerator, or a precursor thereof in proportion to the amount of silver developed, upon development, wherein a layer containing silver halide grains which are not substantially developed by development processing of the light-sensitive material is provided between the two emulsion layers differing in color sensitivity.

That is, an important feature of the present invention involves providing a layer containing silver halide grains which are not substantially developed even after deactivation of an FR compound (hereinafter referred to "non-developable silver halide") between a color-sensitive emulsion layer containing an FR compound and a layer having a different color sensitivity. In order to deactivate an FR compound, it is preferable to use silver halide grains having a large surface area so as to have increased frequency of reaction, i.e., by using fine silver halide grains, and also to use a silver halide emulsion which is not developed by an ordinary surface developing solution even if an electron is donated by the FR compound to be deactivated, e.g., an emulsion having low sensitivity especially an internal latent image type silver halide emulsion.

Thus, fine silver halide grains as hereinafter described are effective to deactivate an FR compound, and the objects of the present invention can be achieved by providing a layer containing such silver halide grains between two silver halide emulsion layers differing in color sensitivity to different colors in a light-sensitive layer containing an FR-releasing compound, preferably in such a manner that said layer directly contacts with the two emulsion layers differing in color sensitivity.

BRIEF DESCRIPTION OF THE DRAWING

FIG. 1 is a graph showing interlayer effect from a red-sensitive emulsion layer to a green-sensitive emulsion layer or a degree of color mixing.

DETAILED DESCRIPTION OF THE INVENTION

FR-releasing compounds which can effectively be used in the present invention include compounds capable of releasing at least one of fogging agents, silver sulfide-forming agents, and silver halide solvents. These compounds release FR compounds upon reacting with an oxidation product of a developing agent which is formed when silver halides are reduced to silver by development processing.

FR compounds which can be used in the present invention include the following examples (i) to (iii). The symbol "FA" as used herein indicates a fogging agent, a development accelerator or precursors thereof.

(i) Couplers capable of releasing FA upon coupling with an oxidation product of an aromatic primary amine developing agent.

(ii) Couplers capable of forming a diffusible coupling product which functions as FA upon coupling with an oxidation product of an aromatic primary amine developing agent.

(iii) Redox compounds capable of releasing FA upon oxidation-reduction reaction with an oxidation product of an aromatic primary amine developing agent or the subsequent reaction.

These compounds (i), (ii) and (iii) can be represented by the following formulae (1), (2) and (3), respectively.

$$\text{Cp—(TIME)}_n\text{—FA} \quad (1)$$

$$\text{BALL—Cp—(TIME)}_n\text{—FA} \quad (2)$$

$$\text{RED—(TIME)}_n\text{—FA} \quad (3)$$

wherein Cp represents a coupler residue capable of coupling with an oxidation product of an aromatic primary amine developing agent; BALL represents a non-diffusible group which is eliminated from Cp upon the coupling reaction with an oxidation product of an aromatic primary amine developing agent; RED represents a residue of a compound capable of undergoing oxidation-reduction reaction with an oxidation product of an aromatic primary amine developing agent; TIME represents a timing group releasable from Cp or RED upon coupling reaction or oxidation-reduction reaction to release FA; n represents 0 or 1; FA represents a group releasable from Cp or RED upon coupling when n is 0, or a group releasable from TIME when n is 1.

In the above-described formula (2), FA may not be released from Cp or TIME after the coupling reaction.

In the above-described formulae (1), (2) and (3), FA represents a so-called fogging agent which reacts with silver halide grains during development to form a fog nucleus capable of starting development. FA includes groups which reductively react with silver halide grains to form fog nuclei and groups which react with silver halide grains to form silver sulfide nuclei capable of starting development.

Preferred FA groups are those containing a group having an adsorbing property onto silver halide grains and can be represented by the formula:

$$\text{AD—(L)}_m\text{—X}$$

wherein AD represents a group adsorptive onto silver halide grains; L represents a divalent group; m represents 0 or 1; and X represents a reducing group or a group capable of reacting with silver halide to form silver sulfide; with proviso that when X is a group capable of reacting with silver halide to form silver sulfide and also has a function of AD, the group AD—$(L)_m$— is not necessarily required.

When FA is a group represented by AD—$(L)_m$—X, it may be bonded to TIME, Cp or RED at an optional position of AD—$(L)_m$—X.

In the formula (1), —$(TIME)_n$—FA is bonded to the coupling position of Cp, and the bond is cleaved upon coupling reaction.

In the formula (2), BALL is bonded to Cp at the coupling position thereof, and the bond is cleaved upon coupling reaction. Since —$(TIME)_n$—FA is bonded to Cp at the non-coupling position thereof, this bond is not cleaved directly by the coupling reaction.

In the formula (3), —$(TIME)_n$—FA is bonded to RED at such a position that —$(TIME)_n$—FA is released therefrom by the oxidation-reduction reaction with an oxidation product of an aromatic primary amine development agent or the subsequent reaction.

The group represented by TIME may be trivalent group in the formula (1). Such being the case, one of the three bonds is bonded to FA and one of the remaining two bonds is bonded to the coupling position of Cp, with the other being bonded to the non-coupling position of Cp. When a compound having such a bond-structure is reacted with an oxidation product of an aromatic primary amine developing agent, the bond between TIME and the coupling position of Cp is cleaved, but the bond at the non-coupling position is not split off. The bond between TIME and FA is then cleaved through electron transfer reaction and/or intramolecular nucleophilic substitution of the anion, i.e., cleaved bond, of TIME whereby FA is released. Therefore, such a compound having a trivalent TIME should also have a structure capable of releasing FA by intramolecular electron transfer reaction and/or intramolecular nucleophilic substitution reaction.

The FR compounds represented by the aforesaid formulae (1), (2) and (3) will further be described in detail below.

In the formula (1), the coupler residue as represented by Cp has a partial structure of yellow, magenta and cyan couplers as well as colorless couplers and black-forming couplers.

Typical examples of the yellow couplers are described in U.S. Pat. Nos. 2,875,057, 2,407,210, 3,265,506, 2,298,443, 3,048,194 and 3,447,928, etc. Of these yellow couplers, acylacetamide derivatives, such as benzoylacetanilide, pivaloylacetanilide, etc., are preferred.

Accordingly, yellow coupler residues as Cp preferably include those represented by the formulae (I) and (II):

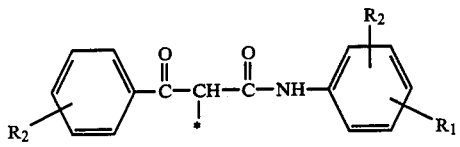
(I)

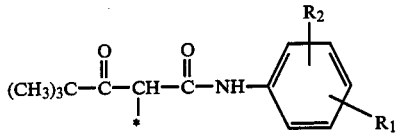
(II)

wherein the asterisk (*) indicates a position to which FA or TIME is bonded (hereinafter the same up to formula (XV)); $R_1$ represents a nondiffusible group having from 8 to 32 total carbon atoms; and $R_2$, which may be the same or different when $R_2$ represents 2 or more groups, represents a hydrogen atom or one or more of a halogen atom, a lower alkyl group, a lower alkoxy group and a nondiffusible group having from 8 to 32 total carbon atoms.

Typical examples of the magenta couplers are described in, e.g., U.S. Pat. Nos. 2,600,788, 2,369,489, 2,343,703, 2,311,082, 3,152,896, 3,519,429, 3,062,653 and 2,908,573, Japanese Patent Publication No. 27411/72 and Japanese Patent Application (OPI) Nos. 171956/84 and 162548/84, etc. Of these, pyrazolones and pyrazoloazoles (e.g., pyrazolopyrazole, pyrazoloimidazole, pyrazolobenzimidazole, pyrazolotriazole, pyrazolotetrazole, etc.) are preferred.

Accordingly, magenta coupler residues as Cp preferably include those represented by the formulae (III), (IV) and (V):

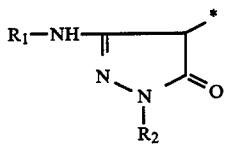
(III)

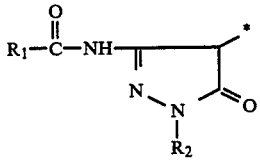
(IV)

-continued

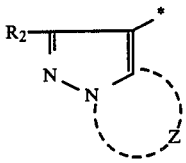
(V)

wherein $R_1$ represents a nondiffusible group having from 8 to 32 total carbon atoms; $R_2$ represents a halogen atom, a lower alkyl group, a lower alkoxy group, a phenyl group or a substituted phenyl group; and Z represents a non-metallic atomic group necessary to form a substituted or unsubstituted 5-membered azole ring containing from 2 to 4 nitrogen atoms (the substituent for the azole ring includes a condensed ring).

Typical examples of the cyan couplers are described in, e.g., U.S. Pat. Nos. 2,772,162, 2,895,826, 3,002,836, 3,034,892, 2,474,293, 2,423,730, 2,367,531 and 3,041,236, Japanese Patent Application (OPI) Nos. 99341/81, 155538/82, 204545/82, 189154/83, 31953/84, 118643/83, 187928/83 and 213748/83, and U.S. Pat. No. 4,333,999, etc. Of these, phenols and naphthols are preferred.

Accordingly, preferred cyan coupler residues as Cp include those having the following formulae (VI), (VII), (VIII) and (IX).

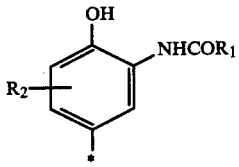
(VI)

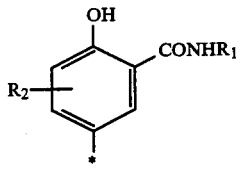
(VII)

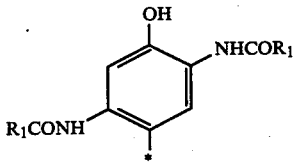
(VIII)

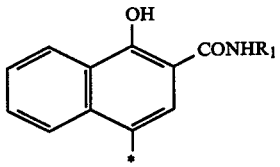
(IX)

wherein $R_1$ represents a nondiffusible group of from 8 to 32 total carbon atoms; and $R_2$, which may be the same or different when $R_2$ represents two or more groups, represents one or more of a halogen atom, a lower alkyl group or a lower alkoxy group.

Specific examples of the colorless couplers are disclosed in, e.g., U.S. Pat. Nos. 3,912,513 and 4,204,867, and Japanese Patent Application (OPI) No. 152721/77, etc.

Typical examples of these colorless couplers have skeletons represented by the following formulae (X), (XI) and (XII).

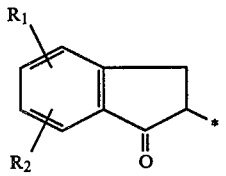
(X)

wherein $R_1$ represents a nondiffusible group of from 8 to 32 total carbon atoms; and $R_2$ represents a hydrogen atom, a halogen atom, a lower alkyl group or a lower alkoxy group.

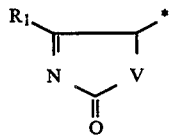
(XI)

wherein $R_1$ represents a nondiffusible group of from 8 to 32 total carbon atoms; and V represents an oxygen atom, a sulfur atom or a nitrogen atom.

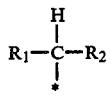
(XII)

wherein $R_1$ and $R_2$ each represents an alkoxycarbonyl group, an aminocarbonyl group, an acyl group, a group derived from a sulfonic acid or sulfinic acid derivative corresponding to the above described groups, a cyano group, an ammoniumyl group, a nitrogen-containing heterocyclic group which is bonded at the N-position thereof, or a like group; $R_1$ and $R_2$ may be bonded together to form a 5- or 6-membered ring.

Cp further includes coupler residues of couplers which form a black color upon reacting with an oxidation product of a developing agent. Examples of such black color forming couplers are described in, e.g., U.S. Pat. Nos. 1,939,231, 2,181,944, 2,333,106 and 4,126,461, West German Patent Application (OLS) Nos. 2,644,194 and 2,650,764, etc.

More specifically, these black color forming couplers are represented by the following formulae (XIII), (XIV) and (XV).

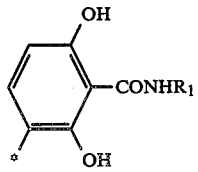
(XIII)

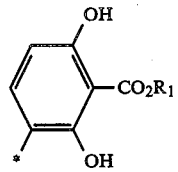
(XIV)

-continued

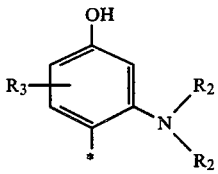
(XV)

wherein $R_1$ represents an alkyl group of from 3 to 20 carbon atoms, a phenyl group, or a phenyl group substituted with a hydroxyl group, a halogen atom, an amimo group or an alkyl or alkoxy group of from 1 to 20 carbon atoms; $R_2$'s, which may be the same or different, represent a hydrogen atom, a halogen atom, an alkyl or alkenyl group of from 1 to 20 carbon atoms or an aryl group of from 6 to 20 carbon atoms; and $R_3$, which may be the same or different when $R_3$ represents two or more groups, represents one or more of a halogen atom, an alkyl or alkoxy group of from 1 to 20 carbon atoms or any other monovalent organic group.

Cp as represented by the above described formulae (I) to (XV) may form a polymer including a dimer, a trimer, etc., at the moiety other than the coupling position, and may also be bonded to a polymer at the moiety other than the coupling position.

In the formula (2), the coupler residues as represented by Cp have partial structures represented by the aforesaid formulae (I) to (XV), wherein the asterisk (*) indicates a position to which BALL is bonded and —(TIME)$_n$—FA is bonded to one of other positions.

In the formula (2), the nondiffusible group as represented by BALL has such a size and a form that impart nondiffusibility to couplers. The nondiffusible group may be a polymeric group comprising a plurality of releasable groups connected to each other, or may have a nondiffusibility-imparting alkyl and/or aryl group(s). In the latter case, the alkyl and/or aryl group(s) preferably contain(s) about 8 to 32 total carbon atoms. BALL has a group for bonding to the coupling position of Cp. Such a group for bonding typically includes —O—, —S—, —N=N—,

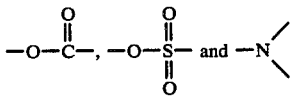

that constitutes a heterocyclic ring.

In the formula (3), the group represented by RED is a group having a skeleton of hydroquinone, catechol, o-aminophenol or p-aminophenol and capable of undergoing oxidation-reduction reaction with an oxidation product of an aromatic primary amine developing agent and subsequently alkali-hydrolysis to thereby release —(TIME)$_n$—FA. In the hereinafter given formulae (XVI) to (XXI), the group —(TIME)$_n$—FA is abbreviated as FR.

Specific examples of RED are represented by the following formulae (XVI) to (XXI).

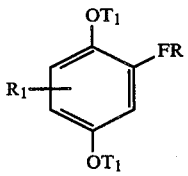
(XVI)

-continued (XVII)

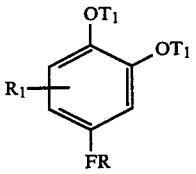

(XVIII)

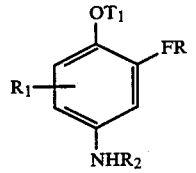

(XIX)

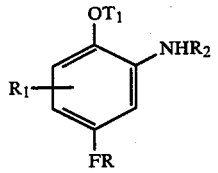

(XX)

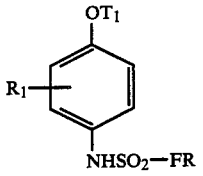

(XXI)

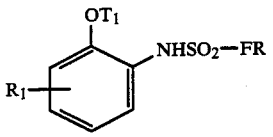

wherein $R_1$ represents a hydrogen atom, a halogen atom, an alkyl group, an aryl group, an alkoxy group, an aryloxy group, an alkylthio group, an arylthio group, a cyano group, an alkoxycarbonyl group, a carbamoyl group, a sulfamoyl group, a carboxyl group, a sulfo group, a sulfonyl group, an acyl group, a carbonamido group, a sulfonamido group or a heterocyclic group; when $R_1$ represents two or more groups, they may be the same or different, or two vicinal $R_1$ groups may be connected to form a benzene ring or a 5- to 7-membered hetero ring; $R_2$ represents an alkyl group, an aryl group, an acyl group, a carbamoyl group, a sulfonyl group or a sulfamoyl group; and $T_1$, which may be the same or different in the formulae (XVI) or (XVII), represents a hydrogen atom or a group releasable by hydrolysis under an alkaline condition.

Typical examples of $T_1$ include a hydrogen atom, an acyl group, a sulfonyl group, an alkoxycarbonyl group, a carbamoyl group, an oxalyl group, etc.

The timing group as represented by TIME can include a group which is releasable from Cp or RED by coupling reaction or oxidation-reduction reaction and then releases FA through intramolecular substitution as described in, e.g., U.S. Pat. No. 4,248,962 and Japanese Patent Application (OPI) No. 56837/82; a group which releases FA by electron transfer reaction via a conjugated system as described in, e.g., British Pat. No. 2,072,363 A and Japanese Patent Application (OPI) Nos. 154234/82, 188035/82, 114946/81, 56837/82, 209736/83, 209727/83, 209738/83, 209740/83 and 98728/83; and a group which releases FA by coupling reaction with an oxidation product of an aromatic primary amine developing agent as described in, e.g., Japanese Patent Application (OPI) No. 111536/82. These reactions may be completed in one step or in multiple steps.

Further, the trivalent TIME group which is bonded to the coupling position and non-coupling position of Cp and FA as hereinbefore described is also preferred. Examples of such a trivalent TIME group is disclosed in Japanese Patent Application (OPI) No. 209740/83 in which TIME is incorporated in a yellow coupler.

When FA contains AD—$(L)_m$—X, AD may be directly bonded to a carbon atom of the coupling position, or either L or X, if releasable upon coupling reaction, may be bonded to the coupling carbon atom. Further, a so-called 2-equivalent coupling-off group may be present between the coupling carbon and AD.

These FA groups can include an alkoxy group (e.g., a methoxy group), an aryloxy group (e.g., a phenoxy group), an alkylthio group (e.g., an ethylthio group), an arylthio group (e.g., a phenylthio group), a heterocyclic oxy group (e.g., a tetrazolyloxy group), a heterocyclic thio group (e.g., a pyridylthio group), a heterocyclic group (e.g., a hydantoinyl group, a pyrazolyl group, a triazolyl group, a benzotriazolyl group, etc.), and the like. In addition, those described in British Pat. No. 2,011,391 can also be used as FA.

The group adsorptive onto silver halide grains as represented by AD can include a group derived from a nitrogen-containing heterocyclic ring having a dissociative hydrogen atom (e.g., pyrrole, imidazole, pyrazole, triazole, tetrazole, benzimidazole, benzopyrazole, benzotriazole, uracil, tetraazaindene, imidazotetrazole, pyrazolotriazole, pentaazaindene, etc.), a heterocyclic ring containing at least one nitrogen atom and other hetero atoms (e.g., an oxygen atom, a sulfur atom, a selenium atom, etc.) (e.g., oxazole, thiazole, thiazoline, thiazolidine, thiadiazole, benzothiazole, benzoxazole, benzoselenazole, etc.), a heterocyclic ring having a mercapto group (e.g., 2-mercaptobenzothiazole, 2-mercaptopyrimidine, 2-mercaptobenzoxazole, 1-phenyl-5-mercaptotetrazole, etc.), a quaternary salt (e.g., quaternary salts of tertiary amine, pyridine, quinoline, benzothiazole, benzimidazole or benzoxazole, etc.), a thiophenol, an alkylthiol (e.g., cysteine), and a compound having a partial structure of

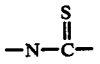

(e.g., thiourea, dithiocarbamate, thioamide, rhodanine, thiazolidinethione, thiohydantoin, thiobarbituric acid, etc.).

The divalent linking group as represented by L in FA is composed of a group selected from an alkylene group, an alkylene group, a phenylene group, a naphthylene group, —O—, —S—, —SO—, —$SO_2$—, —N=N—, a carbonyl group, an amido group, a thioamido group, a sulfonamido group, a ureido group, a thioureido group, a heterocyclic group, etc. If a group capable of being cleaved by the action of a component of a developing solution, such as hydroxide ions, hydroxylamine, sulfite ions, etc., is selected as one of the divalent linking groups which constitute L, the fogging activity can be controlled or deactivated.

The group as represented by X can include groups derived from reducing compounds (e.g., hydrazine, hydrazide, hydrazone, hydroquinone, catechol, p-aminophenol, p-phenylenediamine, 1-phenyl-3-pyrazolidone, enamine, aldehyde, polyamine, acetylene, aminoboran, a quaternary salt such as a tetrazolium salt and an ethylene-bispyridinium salt, carbazic acid, etc.) and groups derived from compounds capable of forming silver sulfide upon development, such as compounds having a partial structure of

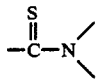

(e.g., thiourea, thioamide, dithiocarbamate, rhodanine, thiohydrantoin, thiazolidinethione, etc.). Of these groups, some of those capable of forming silver sulfide upon development have adsorptivity onto silver halide grains and, therefore, can serve as AD.

Particularly preferred FA can be represented by the following formulae (XXII) and (XXIII).

(XXII)

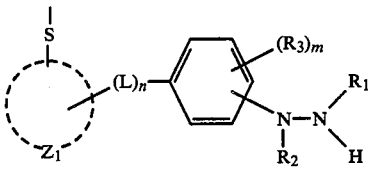

(XXIII)

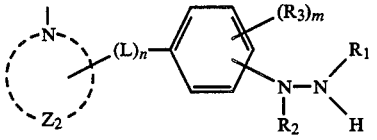

wherein $R_1$ represents an acyl group (e.g., a formyl group, an acetyl group, a propionyl group, a trifluoroacetyl group, a pyruvoyl group, etc.), a carbamoyl group (e.g., a dimethylcarbamoyl group, etc.), an alkylsulfonyl group (e.g., a methanesulfonyl group, etc.), an arylsulfonyl group (e.g., a benzenesulfonyl group, etc.), an alkoxycarbonyl group (e.g., a methoxycarbonyl group, etc.), an aryloxycarbonyl group (e.g., a phenoxycarbonyl group, etc.) or a sulfamoyl group (e.g., a methylsulfamoyl group, etc.); $R_2$ represents a hydrogen atom, an acyl group (e.g., a trifluoroacetyl group, etc.), an alkoxycarbonyl group (e.g., a methoxycarbonyl group, etc.) or an aryloxycarbonyl group (e.g., a phenoxycarbonyl group, etc.); $R_3$ represents a halogen atom (e.g., a fluorine atom, a chlorine atom, etc.), an alkoxy group (e.g., a methoxy group, a methoxyethoxy group, etc.), an alkyl group (e.g., a methyl group, a hydroxymethyl group, etc.), an alkenyl group (e.g., an allyl group, etc.), an aryl group (e.g., a phenyl group, etc.), an aryloxy group (e.g., a phenoxy group, etc.), an alkylthio group (e.g., a methylthio group, etc.), an arylthio group (e.g., a phenylthio group, etc.), a carbonamido group (e.g., an acetamido group, etc.) or a sulfonamido group (e.g., a methanesulfonamido group, etc.); m represents 0 or an integer of from 1 to 4; when m is 2 or more, $R_3$ may be the same or different or two or more of them may be taken together to form a condensed ring; L is a divalent group as defined above; n represents 0 or 1; $Z_1$ represents a monocyclic or condensed hetero ring; and $Z_2$ represents an atomic group necessary to form a monocyclic or condensed ring together with the

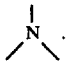

In the formulae (XXII) and (XXIII), specific examples of the monocyclic or condensed hetero rings formed by

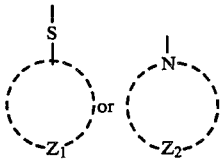

will be shown in examples of AD hereinafter given.

Examples of FR compounds which can be used in the present invention are described in, e.g., Japanese Patent Application (OPI) Nos. 150845/82, 50439/84, 177638/84 and 170840/84.

Specific examples of AD are shown below. In the following formulae, the free bonds are bonded to —(L-)$_m$—X and —(TIME)$_n$—.

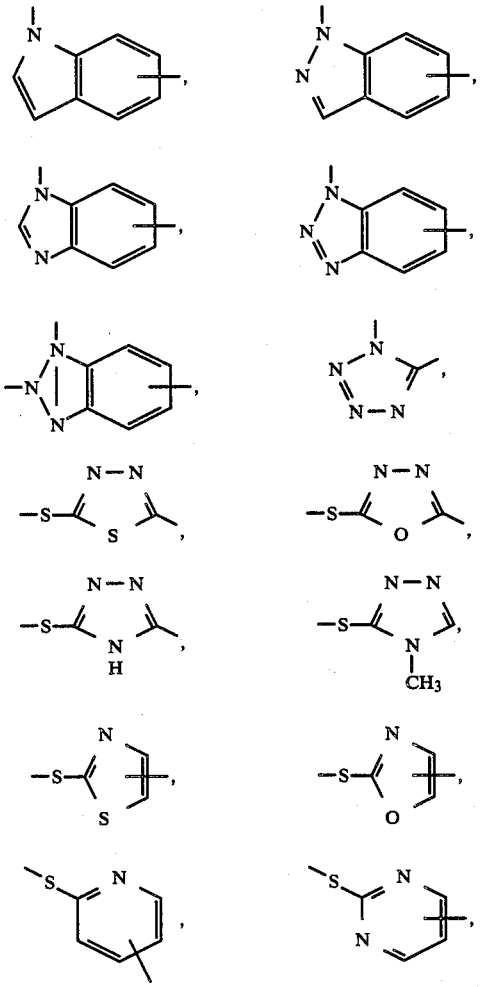

-continued
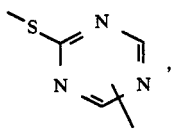
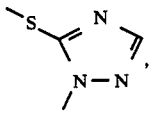
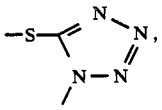
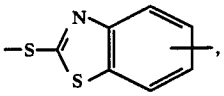
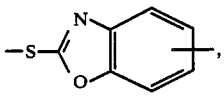
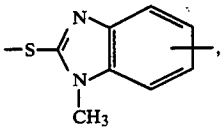
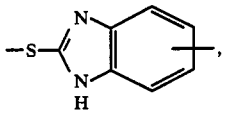
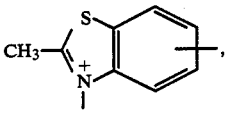
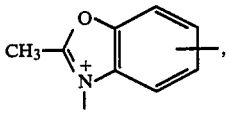
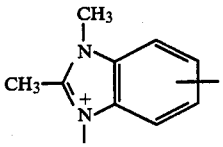
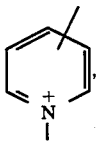
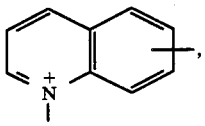
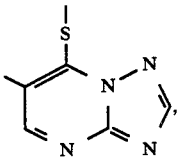
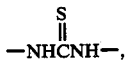
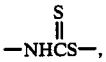
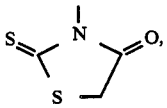
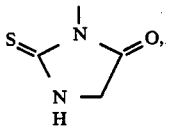
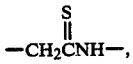
Specific examples of L are shown below.
—$CH_2$—, —$CH_2CH_2$—, —$OCH_2$—, —$OCH_2CH_2$—, —$SCH_2$—, —COO—,
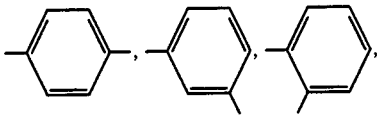
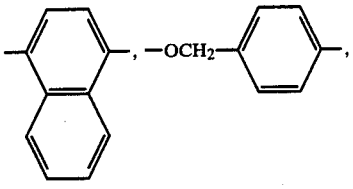
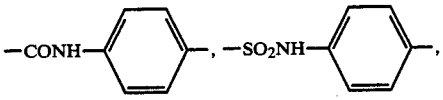
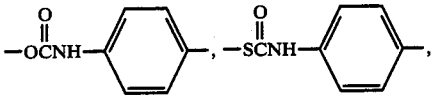
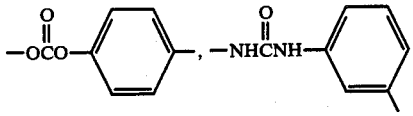
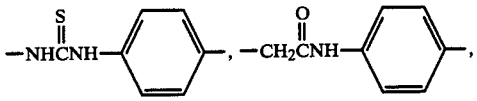
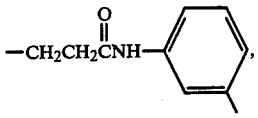
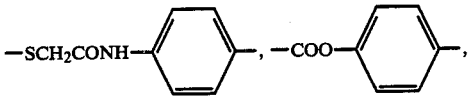
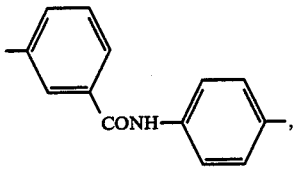
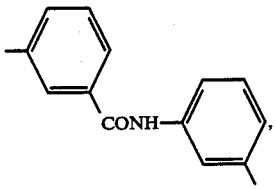

-continued
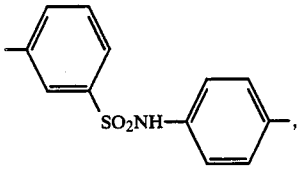
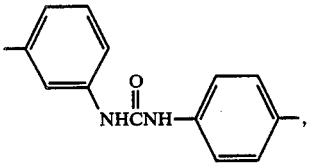
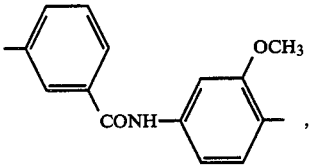
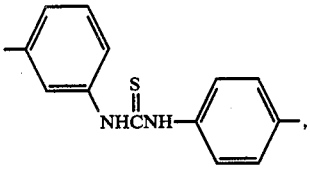
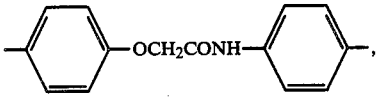
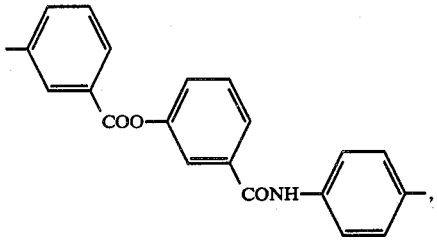
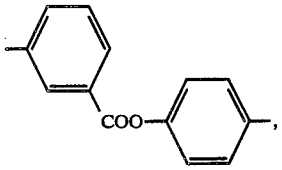
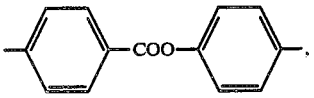
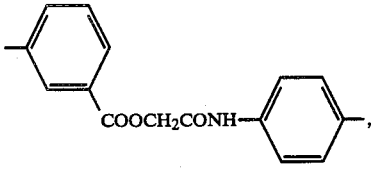
-continued
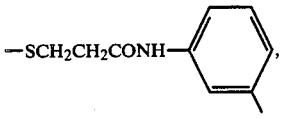
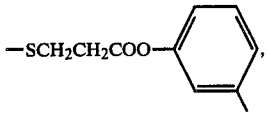
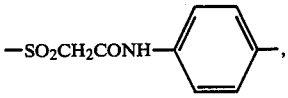
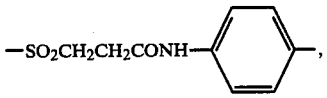
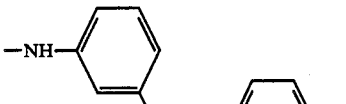
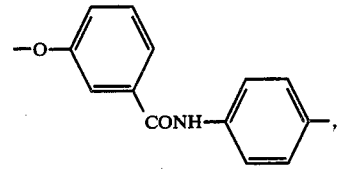
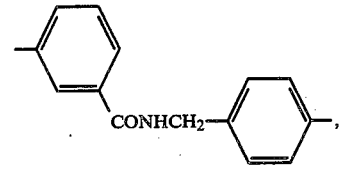
Specific examples of X are shown below. —NHNHCHO, —NHNHCOCH$_3$, —NHNHSO$_2$CH$_3$, —NHNHCOCF$_3$,
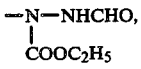
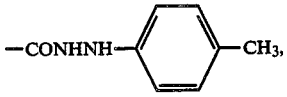
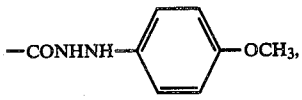
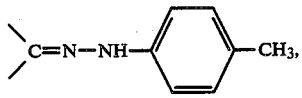

-continued
$-CONHNHCH_3$, $-CONHNH_2$,
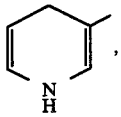
, $-C{\equiv}C-H$, $-CHO$,
$-NH\overset{S}{\overset{\|}{C}}NHCH_3$, $-\overset{S}{\overset{\|}{C}}NH-$ 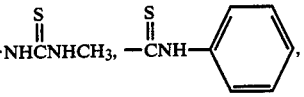 ,
$-S-\overset{S}{\overset{\|}{C}}NHCH_3$, 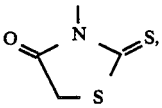 ,
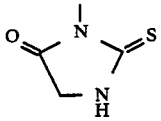
Specific examples of preferred FA groups in the aforesaid formulae (1) to (3) are shown below.
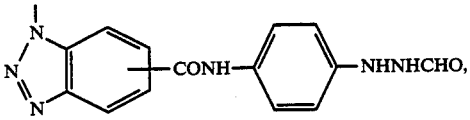
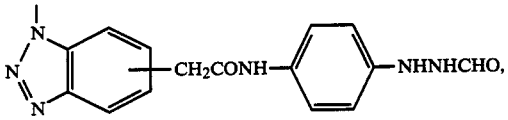
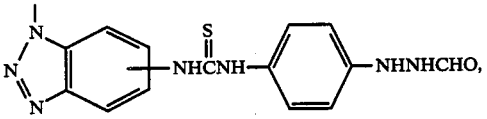
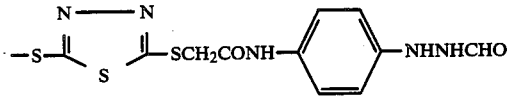
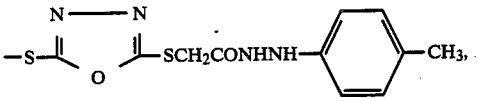
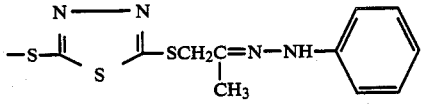
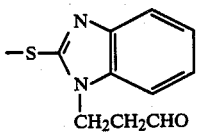
-continued
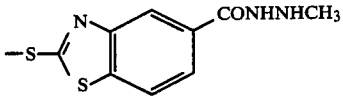
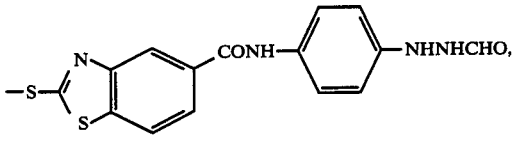
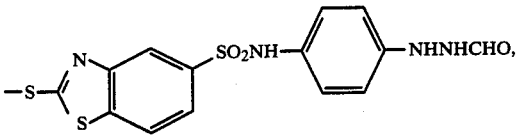
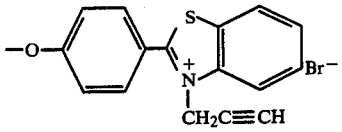
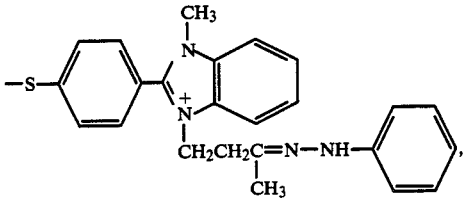
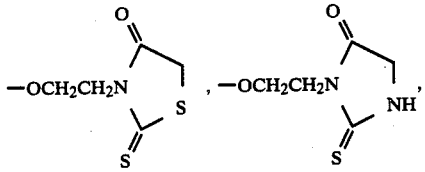
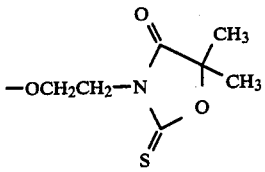
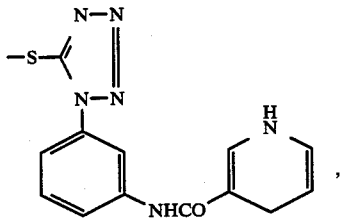
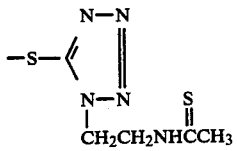
Specific examples of the compounds which can be used in the present invention are shown below.

(I-1)
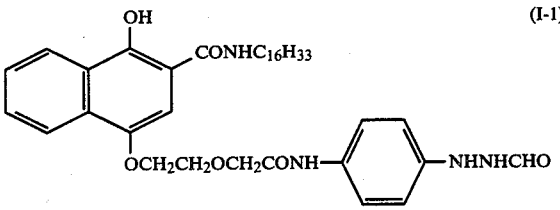
(I-2)
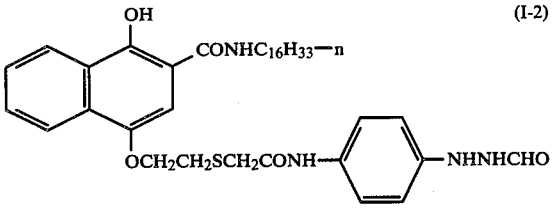
(I-3)
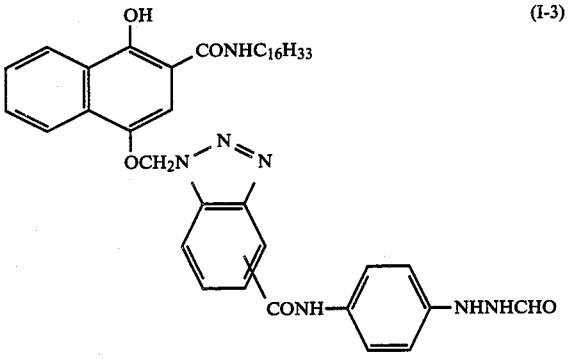
(I-4)
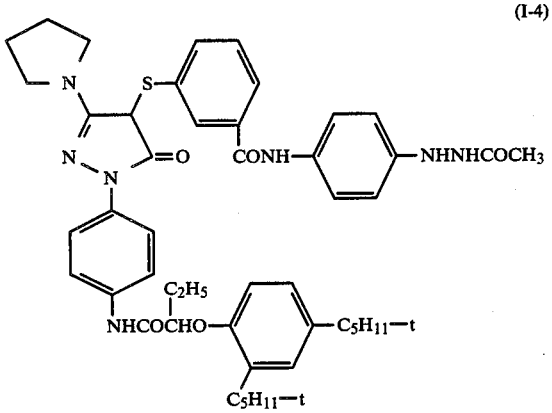
(I-5)
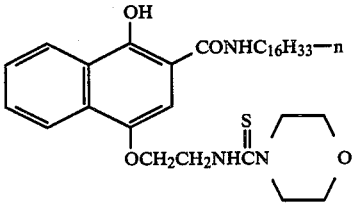
(I-6)
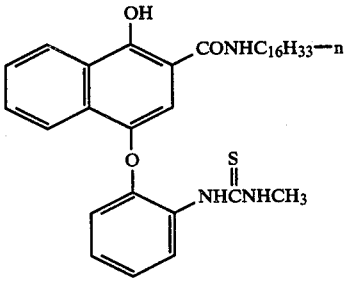
(I-7)
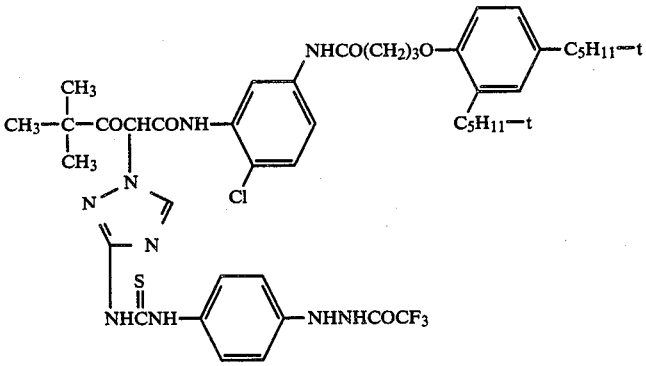
(I-8)
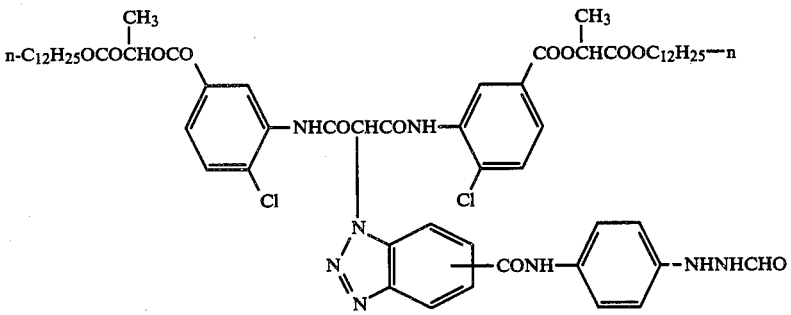

-continued
(I-9)
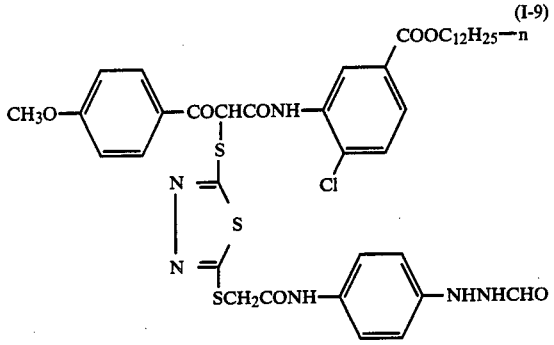
(I-10)
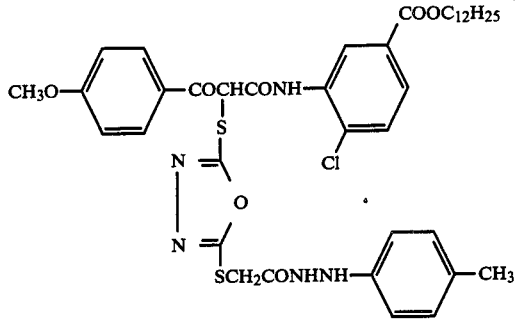
(I-11)
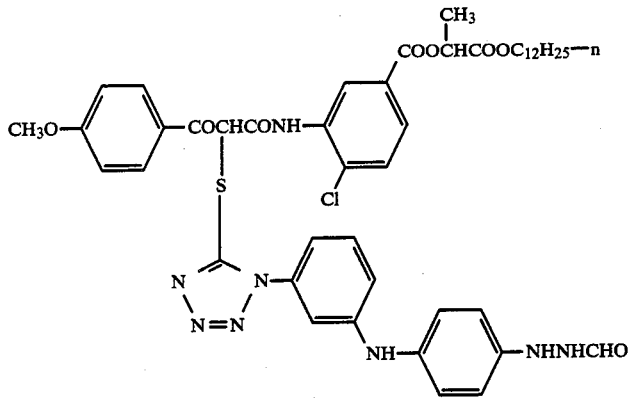
(I-12)
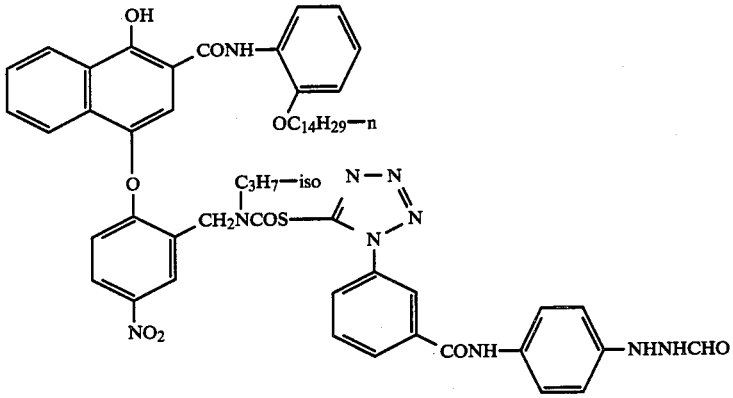
(I-13)
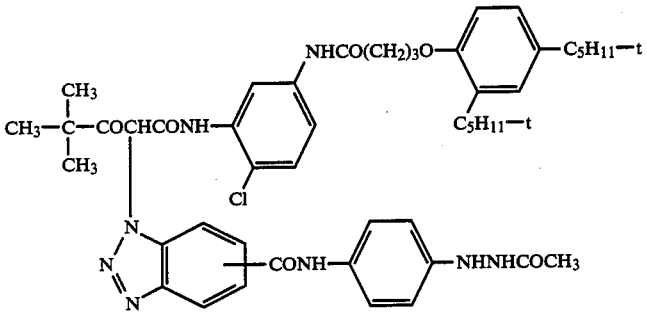

-continued
(I-14)
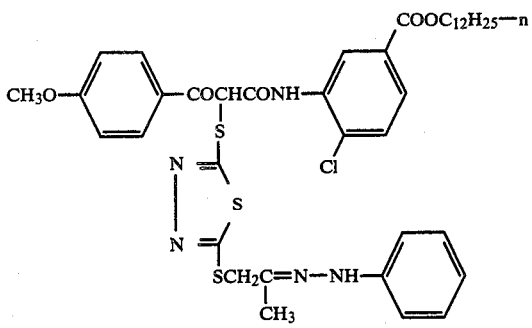
(I-15)
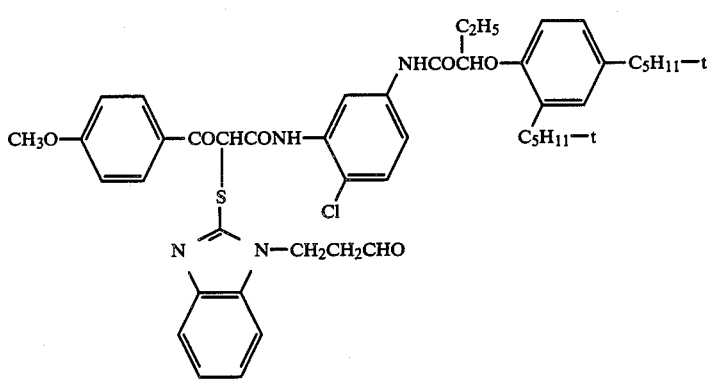
(I-16)
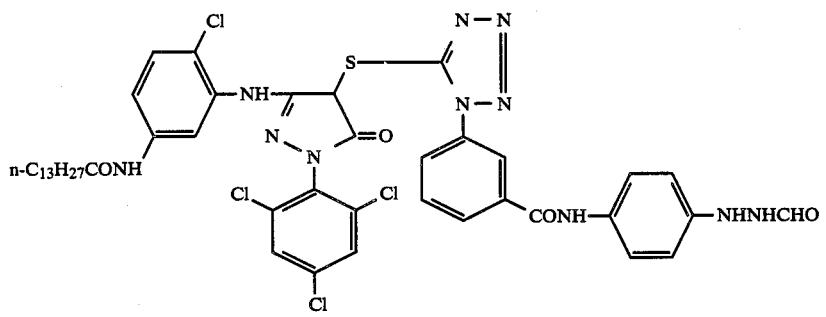
(I-17)
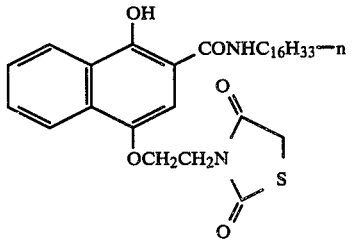
(I-18)
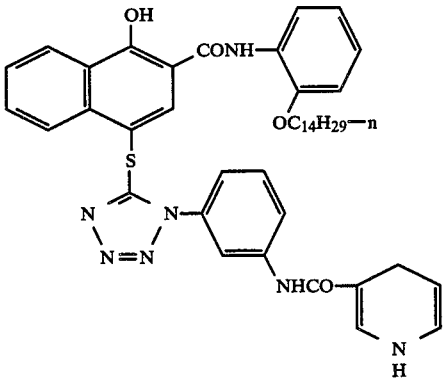

-continued
(I-19)
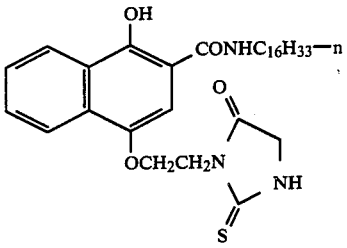
(I-20)
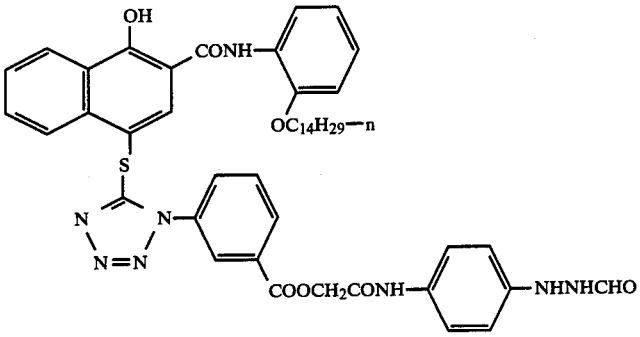
(I-21)
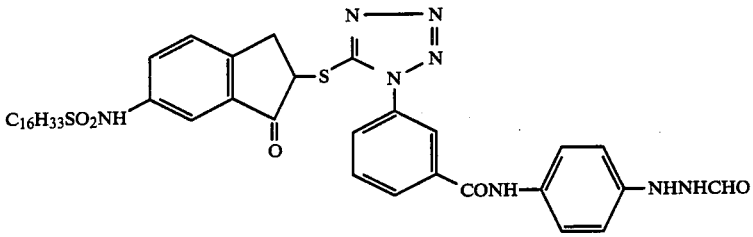
(I-22)
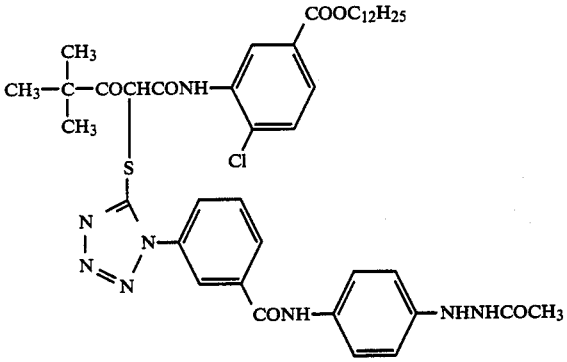
(I-23)
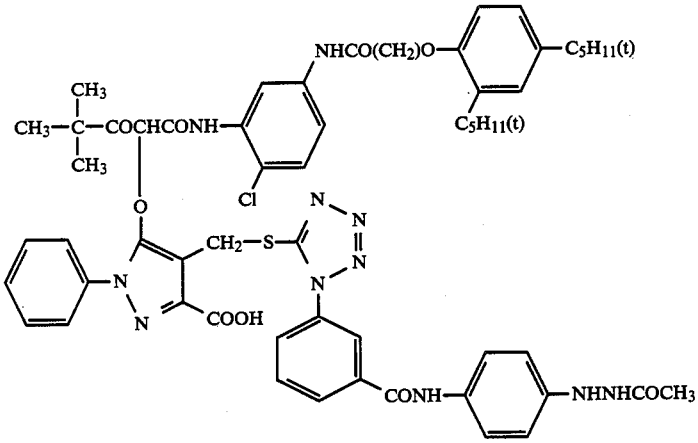

-continued
(I-24)
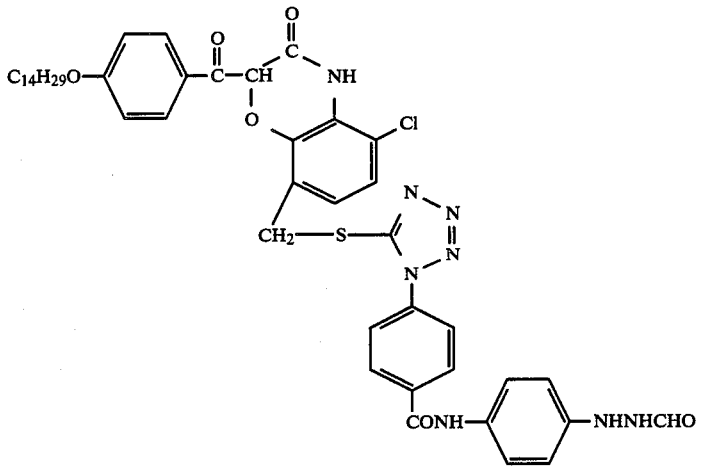
(I-25)
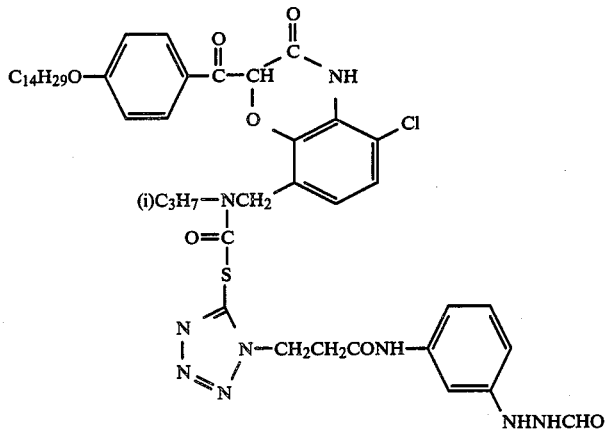
(I-26)
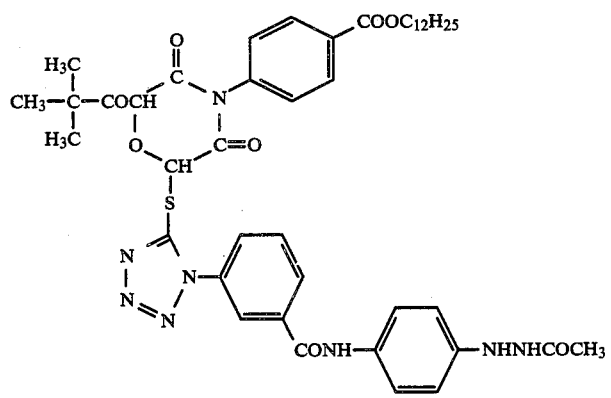
(I-27)
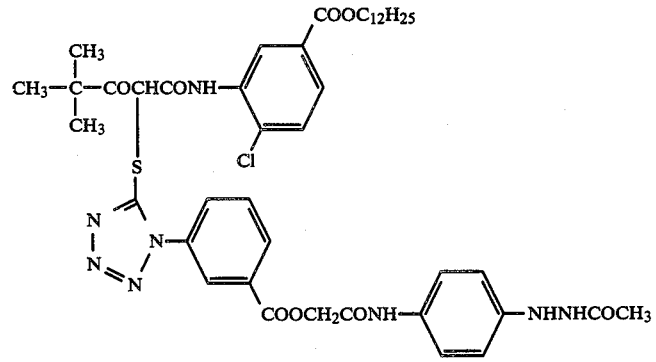

-continued
(I-28)
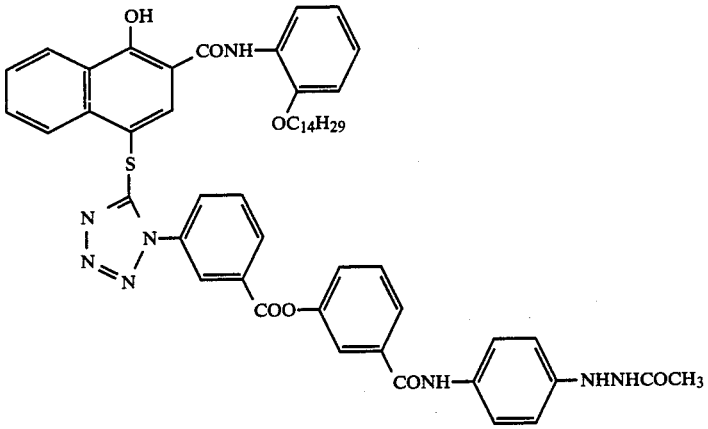
(II-1)
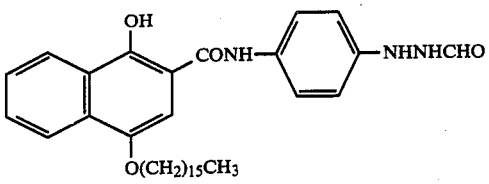
(II-2)
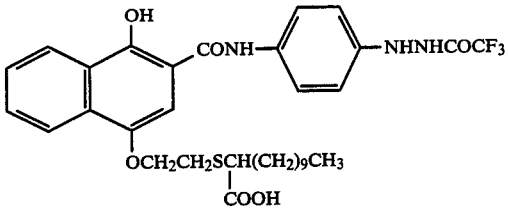
(II-3)
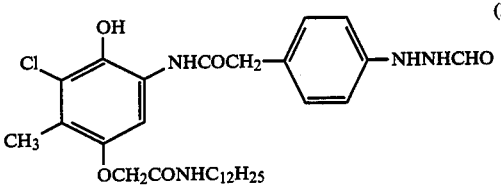
(II-4)
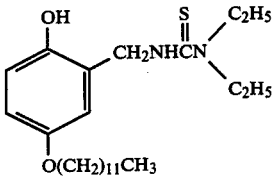
(II-5)
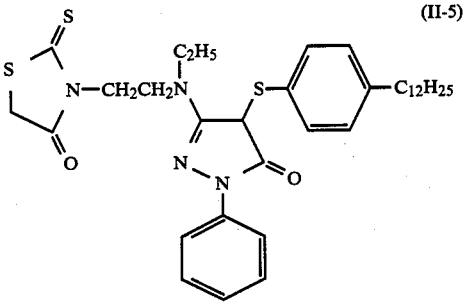
(II-6)
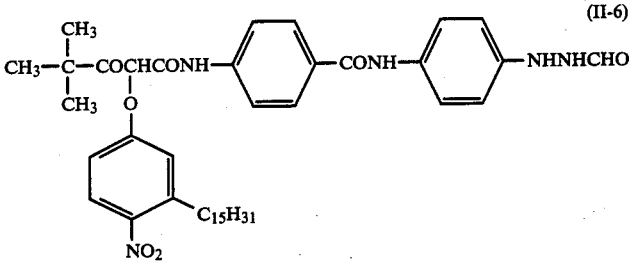
(II-7)
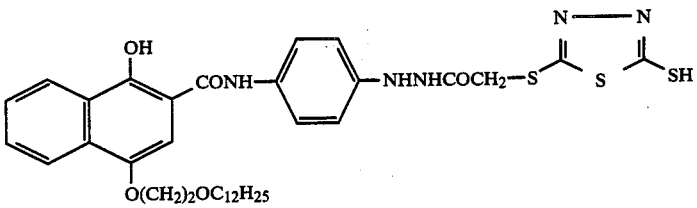
(II-8)
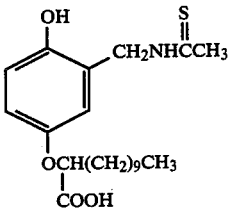
(III-1)
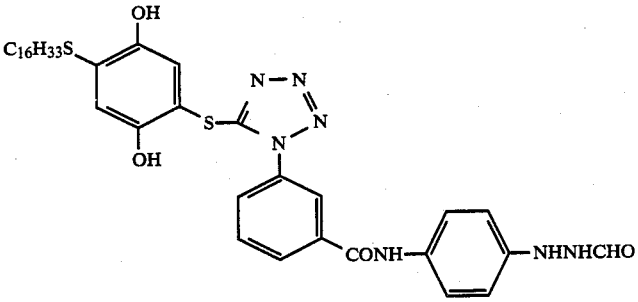

-continued
(III-2)
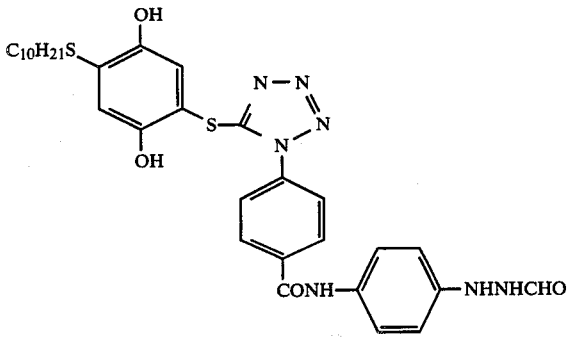
(III-3)
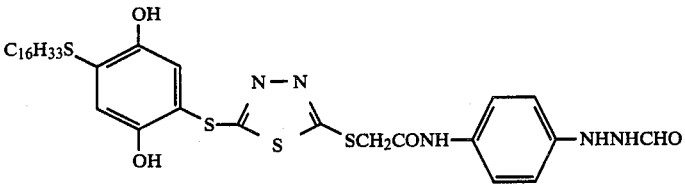
(III-4)
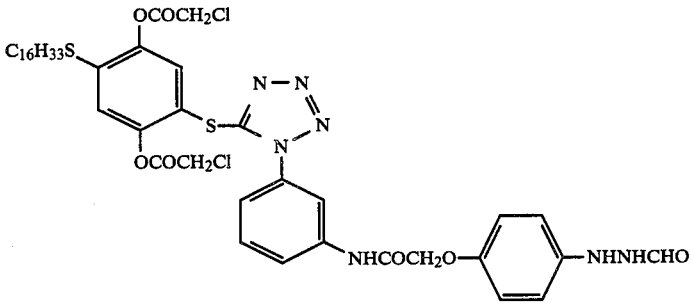
(III-5)
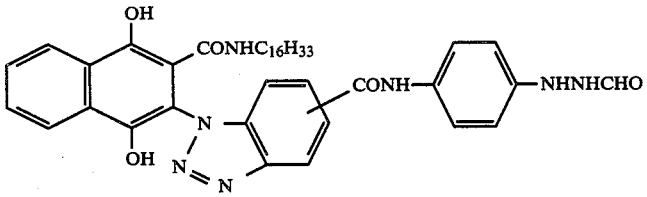
(III-6)
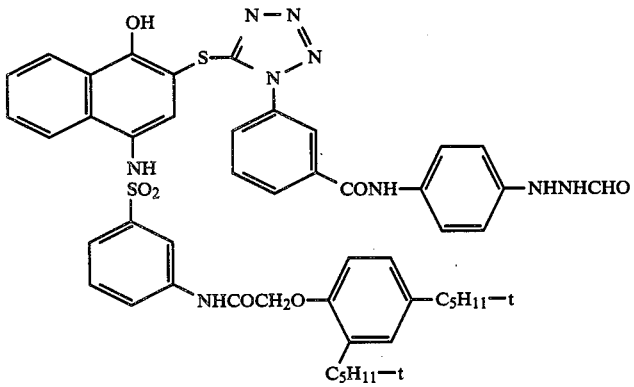

-continued (III-7)

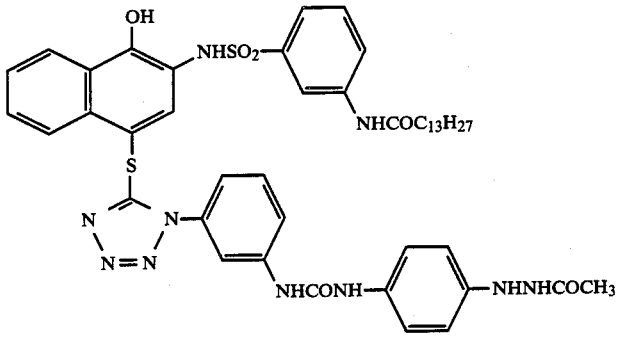

(III-8)

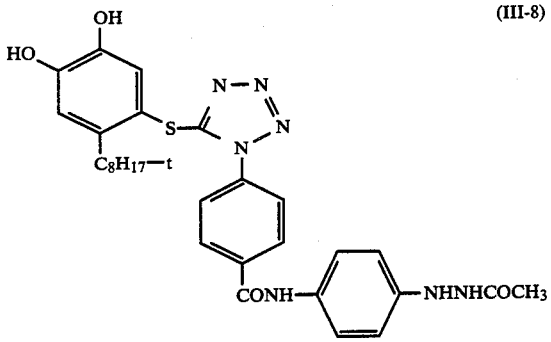

(III-9)

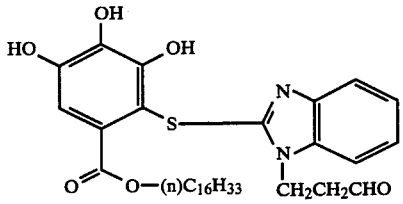

(III-10)

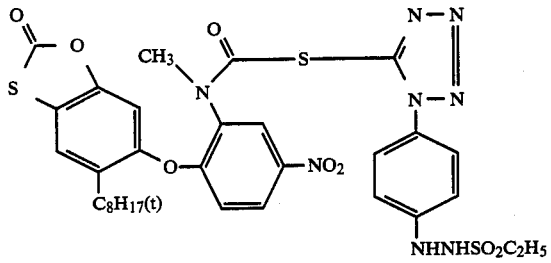

These FR-releasing compounds of the present invention can be synthesized from generally known compounds by the methods described, e.g., in Japanese Patent Application (OPI) Nos. 150845/82 and 138636/82, U.S. Pat. Nos. 3,214,377 and 3,253,924 and Japanese Patent Application Nos. 161515/82, 146097/83 and 214808/83, etc.

The FR-releasing compound is used in an amount ranging from $1\times10^{-8}$ to 0.5 mols, and preferably from $5\times10^{-7}$ to $1\times10^{-2}$ mols, per mol of a silver halide light-sensitive emulsion in which the FR-compound is to be incorporated.

Silver halides which are not substantially developed (hereinafter referred to as "non-developable silver halides") in accordance with the present invention are silver halide grains which are not substantially developed when a light-sensitive material containing such silver halide grains is exposed to an adequate amount of light and then processed under ordinary development conditions. Further, while the development accelerator of the present invention exerts its activity upon acting on silver halides in a light-sensitive layer by development processing; the non-developable silver halide grains in a layer outside of said light-sensitive layer are not substantially developed even after the manifestation of the development accelerator.

The non-developable silver halide grains which can be used in the present invention are not limited to any particular halogen component(s), and include those such as silver chloride, silver bromide, silver iodide, silver chlorobromide, silver iodobromide and silver chloroiodobromide. However, silver halide grains having a silver bromide content of 60 mol% or more, a silver chloride content of 30 mol% or less, and a silver iodide content of 40 mol% or less, are preferred. Silver iodobromide containing from 0 to about 20 mol% of silver iodide is more preferred in view of low developability. The most preferred is silver iodobromide containing from 0.3 to about 5 mol% of silver iodide from the standpoint that light absorption of silver halide grains in the visible region is not increased.

It is preferable that the non-developable silver halide grains according to the present invention have a relatively small grain size in view of low light-sensitivity and less absorption in a visible region. The mean grain size is preferably not more than about 0.2 μm, more preferably not more than 0.15 μm, and most preferably not more than 0.10 μm. In the following description, the non-developable silver halide grains having a mean grain size of not more than about 0.2 μm will be referred to as "fine silver halide grains" or more simply as "fine grains".

The non-developable silver halide emulsion which can be used in the present invention may have an arbitrary grain size distribution, but narrow grain size distribution is preferred. In particular, it is more preferred that the size range of 90% of the weight of the total silver halide grains falls within ±40% of the mean grain size.

The fine silver halide grains which can be used in the present invention can be prepared by using known methods, e.g., the acid process, the neutral process, the ammonia process, and the like. The reaction between a soluble silver salt and a soluble halogen salt can be carried out by any of a single jet method, a double jet method or a combination thereof. The so-called controlled double jet method, in which the pAg of a liquid phase wherein silver halide is formed is maintained constant, can also be employed. This method is advantageous since the resulting silver halide grains have narrow size distribution.

The fine silver halide grains may have a regular crystal form, such as cubic, octahedral, dodecahedral, tetradecahedral, etc., or an irregular crystal form, such as spherical, plate-like, etc. The individual emulsion grains may comprise a core and an outer shell having different halogen compositions, or may be homogeneous. The fine grain emulsion may contain impurities, such as cadmium ions, lead ions, iridium ions, rhodium ions, and the like. Fine grains containing a desensitizer, such as rhodium, in the interior thereof are preferred. The fine grains may be either a surface latent image type or an internal latent image type, and they may contain a fog nucleus in the interior thereof. The internal latent image type silver halide grains can be used to advantage as non-developable silver halide in the present invention because of their non-susceptibility to development with commonly employed surface developers.

The fine grain emulsion may be subjected to conventional chemical sensitization, i.e., sulfur sensitization, gold sensitization, reduction sensitization or a combination thereof. However, it is preferable to use a so-called primitive emulsion that has not been subjected to chemical sensitization.

The fine grain emulsion can contain various dyes, such as cyanine dyes, merocyanine dyes, complex cyanine dyes, complex merocyanine dyes, holopolar cyanine dyes, hemicyanine dyes, styrene dyes, hemioxonol dyes, and the like. Desensitizing dyes that are unfavorable in usual negatively-working emulsions due to their high desensitizing property can also be used in the present invention to advantage. The fine grain emulsion can further contain antifoggants or stabilizers, such as azoles, heterocyclic compounds, mercapto compounds, thioketo compounds, azaindenes, benzenethiosulfonic acids, benzenesulfinic acids, and the like.

The non-developable silver halide emulsion of the present invention generally is used in an amount of from 0.002 to 2 g/m$^2$ (silver coverage), and is preferably used in an amount of from 0.01 to 1 g/m$^2$ (silver coverage). Binders for the non-developable silver halide-containing layer include conventional hydrophilic polymers, and preferably gelatin. The amount of the binder to be used is preferably less than 250 g per mol of silver halides.

The non-developable fine silver halide emulsion is applied between a color-sensitive emulsion layer containing the FR-releasing compound and a layer differing in color sensitivity. In light-sensitive materials containing a development inhibitor-releasing compound in the light-sensitive layer thereof, it is known in the art to provide a fine grain emulsion layer between emulsion layers having different color sensitivites for the purpose of controlling diffusion of a development inhibitor released upon development from a certain light-sensitive emulsion layer into another emulsion layer having a different color sensitivity. This conventional technique takes advantage of the physical adsorption of the development inhibitor onto silver halide grains. On the other hand, in the present invention, it is believed that the FR compound released from the FR-releasing compound undergoes a chemical reaction with the non-developable silver halides, such as electron donation, and is thereby deactivated. This concept is supported by experimental results showing that FR compounds like II-2 having no adsorbing group can be deactivated by the non-developable silver halides.

In the case when three kinds of emulsions A, B, and C having different color sensitivities from each other are provided on a support in the order listed above and the emulsion A contains an FR-releasing compound, the non-developable silver halide grains may be present in either one or both of insensitive intermediate layers provided between A and B and between B and C. It is preferable to incorporate the non-developable silver halide in an insensitive intermediate layer interposed between an emulsion layer containing an FR-releasing compound and the adjacent emulsion layer having color sensitivity different from that of the FR-releasing compound-containing layer. Taking the above-described example wherein the emulsion A contains an FR-releasing compound, the non-developable silver halide is preferably present between the emulsions A and B. When the emulsion B contains an FR-releasing compound, the object of the present invention can be achieved by incorporating the non-developable silver halide in either one of, and preferably both, of the intermediate layer between A and B and the intermediate layer between B and C. In another embodiment in which the emulsion A or C contains an FR-releasing compound, the non-developable silver halide can be incorporated in the emulsion B.

The light-sensitive layer containing an FR-releasing compound according to the present invention may have two or more emulsion layers that differ in sensitivity but are sensitive to the same color, e.g., a combination of a high sensitive emulsion layer and a low sensitive emulsion layer.

These two or more silver halide emulsion layers having substantially the same color sensitivity different sensitivities may or may not be adjacent to each other. It is sufficient that the FR-releasing compound be present in at least one of these layers, but the FR-releasing compound is preferably present in the most sensitive layer.

Layer structures of light-sensitive materials having at least two emulsion layers being sensitive to the same color but different in sensitivity include various embodiments. Some examples are described in *Research Disclosure,* No. 22534 (Jan., 1983). As shown in the specific examples given in this literature, emulsions in which at least 50% of the total projection area of the total silver halide grains is occupied by plate-like silver halide grains each having a grain diameter 5 times or more its thickness can be employed. Further, the object of this invention can be accomplished by incorporating the non-developable silver halide emulsion of the present invention in an intermediate layer, which is preferably insensitive, present between an emulsion layer containing an FR-releasing compound and the adjacent emulsion layer differing in color sensitivity.

The compounds or couplers according to the present invention can be incorporated in silver halide emulsion layers by known methods as described, e.g., in U.S. Pat. No. 2,322,027. For example, the compound is dissolved in a high-boiling organic solvent, such as an alkyl phthalate (e.g., dibutyl phthalate, dioctyl phthalate, etc.), a phosphoric ester (e.g., diphenyl phosphate, triphenyl phosphate, tricresyl phosphate, dioctylbutyl phosphate, etc.), a citric ester (e.g., tributyl acetylcitrate, etc.), a benzoic ester (e.g., octyl benzoate, etc.), an alkylamide (e.g., diethyllaurylamide, etc.), a fatty acid ester (e.g., dibutoxyethyl succinate, diethyl azelate, etc.), a trimesic ester (e.g., tributyl trimesate, etc.), etc., or an organic solvent having a boiling point of from about 30° to 150° C., such as a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, etc., or a mixture of these high-boiling point solvents and low-boiling point solvents, and the resulting solution is dispersed in a hydrophilic colloid.

The dispersion method using a polymer as described in Japanese Patent Publication No. 39850/76 and Japanese Patent Application (OPI) No. 59943/76 can also be employed for the incorporation of the compounds according to the present invention.

When the compound or coupler according to the present invention has an acid group, e.g., a carboxyl group, a sulfo group, etc., it can be incorporated into a hydrophilic colloid as an alkaline aqueous solution thereof.

The photographic emulsion layers of the light-sensitive materials according to the present invention can contain conventional color forming couplers, i.e., compounds capable of forming colors upon oxidative coupling with aromatic primary amine developing agents (e.g., phenylenediamine derivatives, aminophenol derivatives, etc.) in color development processing, in combination with the FR-releasing compounds of the present invention. Examples of the magenta couplers which can be used include 5-pyrazolone couplers, pyrazolobenzimidazole couplers, cyanoacetylcumarone couplers, open-chain acylacetonitrile couplers, and the like. Examples of conventional yellow couplers include acylacetamide couplers (e.g., benzoyl acetanilides, pivaloyl acetanilides, etc.), and the like. Examples of conventional cyan couplers include naphthol couplers, phenol couplers, and the like. It is desirable that these couplers have hydrophobic groups called ballast groups in their molecules and are thereby rendered non-diffusible; alternatively, the couplers can have a polymeric structure. These couplers may be 4-equivalent or 2-equivalent with respect to silver ions. Morover, they may be colored couplers having a color correcting effect.

The light-sensitive materials may contain two or more of the above-described couplers and the like in one layer thereof, or one of these couplers may be incorporated into two or more layers, in order to meet characteristic requirements for the light-sensitive materials.

Photographic color forming couplers to be used can be advantageously selected so as to give a middle-scaled image. It is preferable that cyan dyes formed from cyan couplers have a maximum absorption band between about 600 and about 720 nm; magenta dyes formed from magenta couplers have a maximum absorption band between about 500 and about 580 nm; and yellow dyes formed from yellow couplers have a maximum absorption band between about 400 and about 480 nm.

Binders or protective colloids which can be used in the emulsion layers or intermediate layers of the light-sensitive materials preferably include gelatin, but other hydrophilic colloids may also be used.

Silver halides of photographic emulsion layers which can be used in the light-sensitive materials according to the present invention may be any of silver bromide, silver iodobromide, silver iodochlorobromide, silver chlorobromide and silver chloride. Silver halide emulsions having a silver bromide content of 60 mol% or more, a silver chloride content of 30 mol% or less, and a silver iodide content of 40 mol% or less are useful. The more preferred are silver iodobromide emulsions having a silver iodide content of from 2 to 25 mol%, with those having a silver iodide content of from 8 to 25 mol% being the most preferred.

A mean grain size of silver halide grains in the photographic light-sensitive emulsions (the grain size being defined as grain diameter if the grain has a spherical or a nearly spherical form and as a length of the edge if the grain has a cubic form, and being averaged based on projected areas of the total grains) is not particularly restricted. However, the emulsion to be used in the layer containing the FR-releasing compound of the present invention preferably has a mean grain size of not less than 0.6 μm, more preferably not less than 1.0 μm, and most preferably not less than 1.5 μm. Grain size distribution may be either narrow or broad.

Light-sensitive silver halide grains in the photographic emulsion may have a regular crystal form, such as cubic, octahedral, etc., an irregular crystal form, such as spherical, plate-like, etc., or a composite form thereof. Silver halide grains may be a mixture of grains having various crystal forms.

Further, an emulsion in which a plate-like silver halide grain having a diameter 5 times or more its thickness occupies 50% or more of the total projection area may also be employed.

The individual light-sensitive silver halide grains may have a so-called core-shell structure having different halogen compositions between the inside and surface thereof. In addition, they may be grains wherein a latent image is predominantly formed on their surface, or may be grains where a latent image is predominantly formed in the interior thereof.

Two or more light-sensitive silver halide emulsions which have been separately prepared can be used as a mixture.

In a process for producing light-sensitive silver halide grains or physical ripening of the produced grains, cadmium salts, zinc salts, lead salts, thallium salts, iridium salts or complex salts thereof, rhodium salts or complex salts thereof, iron salts or complex salts thereof, and the like may be present.

After the formation of silver halide grains or the physical ripening of the grains, soluble salts are usually removed from the emulsion by, for example, a conventionally known noodle washing method comprising gelling the gelatin, or a sedimentation (flocculation) method using an inorganic salt composed of a polyvalent anion (e.g., sodium sulfate), an anionic surface active agent, an anionic polymer (e.g., polystyrenesulfonic acid) or a gelatin derivative (e.g., aliphatic acylated gelatin, aromatic acylated gelatin or aromatic acylated gelatin).

The light-sensitive silver halide emulsion is usually subjected to chemical sensitization. Chemical sensitization can be carried out using processes as described in, e.g., H. Frieser (ed.), Die *Grundlagen der Photographischen Prozesse mit Silberhalogeniden,* 675–734, Akademische Verlagsgesellschaft (1968).

More specifically, chemical sensitization can be achieved by sulfur sensitization using compounds containing sulfur capable of reacting with active gelatin or silver ions (e.g., thiosulfates, thioureas, mercapto compounds, rhodanines, etc.); reduction sensitization using reducing materials (e.g., stannous salts, amines, hydrazines, formamidinesulfinic acid, silane compounds, etc.); noble metal sensitization using noble metal compounds (e.g., gold complexes, and complexes of Periodic Table Group VIII metals such as Pt, Ir, Pd, etc.); and the like, individually, or in combinations thereof.

Photographic light-sensitive emulsions used in the present invention can contain various compounds for the purpose of preventing fog in the preparation, storage, photographic processing, or stabilizing photographic properties. Specific examples of such compounds include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds, such as oxazolinethione, etc.; azaindenes, such as triazaindenes, tetraazaindenes (particularly 4-hydroxy-substituted (1,3,3*a*,7)tetraazaindenes), pentaazaindenes, etc.; benzenethiosulfonic acid; benzenesulfinic acid; benzenesulfonic acid amide; and other various compounds known as anti-foggants or stabilizers.

For details of specific examples and usages of these compounds, disclosures in, e.g., U.S. Pat. Nos. 3,954,474 and 3,982,947, and Japanese Patent Publication No. 28660/77 can be referred to.

Specific examples of surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or alkyl aryl ethers, polyethylene glycol esters, polyethylene glycol sorbitan esters, polyalkylene glycol alkylamines or alkylamides, polyethylene oxide adducts of silicone, etc.), glycidol derivatives (e.g., alkenylsuccinic polyglycerides, alkylphenol polyglycerides, etc.), fatty acid esters of polyhydric alcohols, alkyl esters of sugars, and the like; anionic surface active agents containing acidic groups, e.g., a carboxyl group, a sulfo group, a phospho group, a sulfuric ester group, a phosphoric ester group, etc., such as alkylcarboxylates, alkylsulfonates, alkylbenzenesulfonates, alkylnapthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, and the like; amphoteric surface active agents, such as amino acids, aminoalkylsulfonic acids, aminoalkyl sulfates or phosphates, alkylbetaines, amine oxides and the like; and cationic surface active agents, such as alkylamine salts, aliphatic or aromatic quaternary ammonium salts, heterocyclic quaternary ammonium salts (e.g., pyridinium, imidazolium, etc.), aliphatic or heterocyclic phosphonium or sulfonium salts, and the like.

The photographic emulsions of the photographic light-sensitive materials according to the present invention may contain, for example, polyalkylene oxides or derivatives thereof (e.g., ethers, esters and amines thereof), thioether compounds, thiomorpholines, quaternary ammonium salt compounds, urethane derivatives, urea derivatives, imidazole derivatives, 3-pyrazolidones, and the like for the purpose of increasing sensitivity or contrast or accelerating development. Examples of such compounds are disclosed, e.g., in U.S. Pat. Nos. 2,400,532, 2,423,549, 2,716,062, 3,617,280, 3,772,021 and 3,808,003, British Pat. No. 1,488,992, etc.

The photographic emulsion layers or other hydrophilic colloidal layers of the light-sensitive materials of the present invention can further contain dispersions of water-insoluble or slightly soluble synthetic polymers for the purpose of improving dimensional stability and so on. Such polymers include those having, as monomer components, one or more of alkyl (meth)acrylates, alkoxyalkyl, (meth)acrylates, glycidyl (meth)acrylate, (meth)acrylamide, vinyl esters (e.g., vinyl acetate), acrylonitrile, olefins and styrene, or a conbination of these monomers and acrylic acid, methacrylic acid, an $\alpha,\beta$-unsaturated dicarboxylic acid, a hydroxyalkyl (meth)acrylate, a sulfoalkyl (meth)acrylate, styrenesulfonic acid, etc.

Any of conventional methods and processing solutions as described, e.g., in *Research Disclosure,* No. 176, 28–30, can be applied to photographic processing of the light-sensitive materials according to the present invention. Any photographic processing, whether for the formation of silver images (achromatic photographic processing) or for the formation of dye images (color photographic processing), can be used depending on the intended end use of the light-sensitive material. Processing temperatures are generally selected from 18° to 50° C., but temperatures outside of this range may also be used. However, the light-sensitive materials having the non-developable silver halide layer according to the present invention can exert its conspicuous effect particularly when developed at a high temperature of 30° C. or more. In addition, the light-sensitive materials according to the present invention can effectively be employed in a continuous processing system using a replenisher.

For development processing, a method where a developing agent is contained in the light-sensitive material, e.g., in an emulsion layer, and the light-sensitive material is treated in an aqueous alkaline solution to effect development may be employed. Developing agents which are hydrophobic can be incorporated in emulsion layers using various methods as described, e.g., in *Research Disclosure,* No. 169 (RD-16928), U.S. Pat. No. 2,739,890, British Pat. No. 813,253, West German Pat. No. 1,547,763, etc. Such development processing may be carried out in combination with silver salt stabilizing processing using a thiocyanate.

A conventional fixing solution can be employed. Examples of fixing agents which can be used include not only thiosulfates and thiocyanates, but also organic sulfur compounds which are known to have a fixing effect. The fixing solution may contain a water-soluble aluminum salt as a hardener.

Dye images can be formed in accordance with conventional methods, for example, the negative-positive method as described, e.g., in *Journal of the Society of Motion Picture and Television Engineers,* vol. 61, 667–701 (1953).

Developing solutions which can be used for achromatic photographic processing can contain conventionally known developing agents. Examples of such developing agents include dihydroxybenzenes (e.g., hydroquinone), 3-pyrazolidones (e.g., 1-phenyl-3-pyrazolidone), aminophenols (e.g., N-methyl-p-aminophenol), ascorbic acid, etc. or combinations thereof. The developing solution generally contains known preservatives, alkali agents, pH buffers, antifoggants, and the like, and may further contain, if desired, dissolution assistants, color toning agents, development accelerators, surface active agents, defoaming agents, water softeners, hardeners, viscosity-imparting agents, and the like.

Color developing solutions which can be used for color photographic processing generally comprise an alkaline aqueous solution containing a color developing agent. Specific examples of the color developing agents include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.).

In addition to the above-described color developing agents, those described in L. F. A., Mason, *Photographic Processing Chemistry*, 226–229, Focal Press (1966), U.S. Pat. Nos. 2,193,015 and 2,592,364, Japanese Patent Application (OPI) No. 64933/73, etc., may also be employed.

The color developing solution can additionally contain a pH buffer, e.g., a sulfite, carbonate, borate or phosphate of an alkali metal, a development inhibitor or antifoggant, e.g., a bromide, an iodide, an organic antifoggant, etc. If desired, it may further contain a water softener, a preservative (e.g., hydroxylamine), an organic solvent (e.g., benzyl alcohol, diethylene glycol, etc.), a development accelerator (e.g., polyethylene glycol, quaternary ammonium salts, amines, etc.), a color forming coupler, a competing coupler, a fogging agent (e.g., sodium boron hydride), an assistant developer (e.g., 1-phenyl-3-pyrazolidone), a viscosity-imparting agent, a polycarboxylic acid series chelating agent, an antioxidant, and the like. Specific examples of these additives are disclosed, e.g., in *Research Disclosure*, No. 176 (RD-17643), U.S. Pat. No. 4,083,723, West German Patent Application (OLS) No. 2,622,950, etc.

After color development, the photographic emulsion is generally subjected to a conventional bleaching treatment. Bleaching may be carried out simultaneously with fixing, or these two processes may be carried out separately. Bleaching agents which can be used include, for example, compounds of polyvalent metals, such as iron (III), cobalt (III), chromium (IV), copper (II), etc., peroxy acids, quinones, nitroso compounds, and the like. More specifically, useful bleaching agents include ferricyanides; bichromates; complex salts formed by iron (III) or cobalt (III) and aminopolycarboxylic acids, e.g., ethylenediaminetetraacetic acid, nitrilotriacetic acid, 1,3-diamino-2-propanoltetraacetic acid, etc., or organic acids, e.g., citric acid, tartaric acid, malic acid, etc.; persulfates; permanganates; nitrosophenol; and the like. Of these, potassium ferricyanide, sodium(ethylenediaminetetraacetato)ferrate (III), and ammonium(ethylenediaminetetraacetato)ferrate (III) are particularly useful. The (ethylenediaminetetraacetato)iron (III) complexes are useful in either an independent bleaching solution or a combined bleach-fix solution.

The bleaching or bleach-fix bath can contain a bleach accelerating agent as described in U.S. Pat. Nos. 3,042,520 and 3,241,966, Japanese Patent Publication Nos. 8506/70 and 8836/70, etc., thiol compounds as described in Japanese Patent Application (OPI) No. 65732/78, and various other conventional additives.

Photographic light-sensitive emulsions employed in the present invention may be spectrally sensitized with methine dyes and others. Sensitizing dyes which can be used for spectral sensitization include cyanine dyes, merocyanine dyes, complex cyanine dyes, complex merocyanine dyes, holopolar cyanine dyes, hemicyanine dyes, styryl dyes and hemioxonol dyes. Of these, cyanine dyes, merocyanine dyes and complex merocyanine dyes are particularly useful. Any nuclei commonly used for cyanine dyes as basic heterocyclic nuclei can be applied to the above-described dyes. Specific examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above-recited nuclei to which an alicyclic hydrocarbon ring is fused; and the above-recited nuclei to which an aromatic hydrocarbon ring is fused, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinone nucleus, etc. These nuclei may be substituted at their carbon atoms.

The merocyanine dyes or complex merocyanine dyes can have a 5- to 6-membered heterocyclic nucleus as a nucleus haing a ketomethylene structure, such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc.

These sensitizing dyes can be used alone or in combinations thereof. Combinations of sensitizing dyes are frequently employed for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Application Nos. 4936/68 and 12375/78 and Japanese Patent Application (OPI) Nos. 110618/77 and 109925/77, etc.

The photographic emulsions may also contain compounds which do not exhibit per se any spectral sensitizing activity or do not substantially absorb visible light, but which exhibit a supersensitizing activity when used in combination with the above-described sensitizing dyes. Such compounds include, for example, aminostyryl compounds as described, e.g., in U.S. Pat. Nos. 2,933,390 and 3,635,721, aromatic organic acid-formaldehyde condensates as described, e.g., in U.S. Pat. No. 3,743,510, cadmium salts, azaindene compounds, and the like. Combinations disclosed in U.S. Pat. Nos. 3,615,613, 3,615,641, 3,617,295 and 3,635,721 are particularly useful.

The present invention can be applied to a multilayer multicolor photographic material comprising a support having provided thereon at least two layers having different spectral sensitivities. A multilayer color photographic material usually has at least one red-sensitive emulsion layer, at least one green-sensitive emulsion layer, and at least one blue-sensitive emulsion layer on its support. The order of these layers can be arbitrarily selected. A cyan forming coupler is generally incorporated in a red-sensitive emulsion layer, a magenta forming coupler in a green-sensitive layer, and a yellow forming coupler in a blue-sensitive emulsion layer, respectively, but different combinations may be used in some cases.

In the photographic light-sensitive materials according to the present invention, the photographic emulsion layers or other hydrophilic colloidal layers may contain inorganic or organic hardeners. Examples of such hardeners include, for example, chromium salts (e.g., chromium alum, chromium acetate, etc.), aldehydes (e.g., formaldehyde, glyoxal, glutaraldehyde, etc.). N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), and the like. These hardeners can be used alone or in combinations thereof.

In the case that the hydrophilic colloidal layers of the photographic light-sensitive materials of the present invention contain dyes or ultraviolet absorbents, they may be mordanted by cationic polymers and the like.

The light-sensitive materials prepared by the present invention may contain a color fog preventing agent, such as a hydroquinone derivative, an aminophenol derivative, a gallic acid derivative, an ascorbic acid derivative, and the like.

The hydrophilic colloidal layers of the photographic materials prepared in accordance with the present invention may contain ultraviolet absorbents. Such ultraviolet absorbents include, for example, bentotriazole compounds substituted with aryl groups as described, e.g., in U.S. Pat. No. 3,533,794, 4-thioazolidone compounds as described, e.g., in U.S. Pat. Nos. 3,314,794 and 3,352,681, benzophenone compounds as described, e.g., in Japanese Patent Application (OPI) No. 2784/71, cinnamic esters as described, e.g., in U.S. Pat. Nos. 3,705,805 and 3,707,375, butadiene compounds as described, e.g., in U.S. Pat. No. 4,045,229, benzoxazole compounds as described, e.g., in U.S. Pat. No. 3,700,455, and the like. The ultraviolet absorbents described in U.S. Pat. No. 3,499,762 and Japanese Patent Application (OPI) No. 48535/79 can also be used. Ultraviolet absorbing couplers or ultraviolet absorbing polymers may also be used.

Hydrophilic colloidal layers of the light-sensitive materials prepared in accordance with the present invention may contain water-soluble dyes for various purposes, e.g., as filter dyes or for prevention of irradiation. Examples of such dyes include oxonol dyes, hemioxonol dyes, styryl dyes, merocyanine dyes, cyanine dyes and azo dyes. Of these, oxonol dyes, hemioxonol dyes and merocyanine dyes are particularly useful.

In carrying out the present invention, known discoloration inhibitors, such as hydroquinone derivatives, gallic acid derivatives, p-alkoxyphenols, p-oxyphenol derivatives, bisphenols, etc., can be used. In addition, color image stabilizing agents can be used individually or in combination of two or more thereof.

In one of the preferred embodiments according to the present invention, there is provided a silver halide photographic light-sensitive material comprising a support having formed thereon at least two emulsion layers differing in color sensitivity and at least two emulsion layers that are sensitive to the same color but different in sensitivity, at least one of these emulsion layers containing at least one compound capable of releasing a fogging agent or a development accelerator or a precursor thereof in proportion to the amount of developed silver upon development; wherein a layer containing silver halide grains which are not substantially developed by the development processing for the light-sensitive material is provided between the two emulsion layers differing in color sensitivity.

The present invention will now be illustrated in greater detail by reference to a specific example, but it is to be understood that the present invention is not limited thereto.

EXAMPLE

In order to evaluate effectiveness of the present invention, a multilayer color light-sensitive material composed of the following layers was prepared. The resulting sample was designated as Sample 101.

In the following formulations, the amounts of emulsions applied are expressed by silver coverages.

Sample 101

| | |
|---|---|
| First Layer (Antihalation Layer): | |
| A gelatin layer containing; | |
| Black colloidal silver | 0.18 g/m$^2$ |
| Ultraviolet absorbent C-1 | 0.12 g/m$^2$ |
| Ultraviolet absorbent C-2 | 0.17 g/m$^2$ |
| Second Layer (Intermediate Layer): | |
| A gelatin layer containing; | |
| 2,5-Di-t-pentadecylhydroquinone | 0.18 g/m$^2$ |
| Coupler C-3 | 0.11 g/m$^2$ |
| Silver iodobromide emulsion (silver iodide: 1 mol %; mean grain size: 0.07 μm) | 0.15 g/m$^2$ |
| Third Layer (First Red-Sensitive Emulsion Layer): | |
| A gelatin layer containing; | |
| Silver iodobromide emulsion (silver iodide: 4 mol %; mean grain size: 0.6 μm) | 0.72 g/m$^2$ |
| Sensitizing Dye I | $7.0 \times 10^{-5}$ mol per mol of Ag |
| Sensitizing Dye II | $2.0 \times 10^{-5}$ mol per mol of Ag |
| Sensitizing Dye III | $2.8 \times 10^{-4}$ mol per mol of Ag |
| Sensitizing Dye IV | $2.0 \times 10^{-5}$ mol per mol of Ag |
| Coupler C-4 | 0.093 g/m$^2$ |
| Coupler C-5 | 0.31 g/m$^2$ |
| Coupler C-6 | 0.010 g/m$^2$ |
| Fourth Layer (Second Red-Sensitive Emulsion Layer): | |
| A gelatin layer containing; | |
| Silver iodobromide emulsion (silver iodide: 6 mol %; mean grain size: 1.5 μm) | 1.6 g/m$^2$ |
| Sensitizing Dye I | $5.2 \times 10^{-5}$ mol per mol of Ag |
| Sensitizing Dye II | $1.5 \times 10^{-5}$ mol per mol of Ag |
| Sensitizing Dye III | $2.1 \times 10^{-4}$ mol per mol of Ag |
| Sensitizing Dye IV | $1.5 \times 10^{-5}$ mol per mol of Ag |
| Coupler C-4 | 0.10 g/m$^2$ |
| Coupler C-5 | 0.061 g/m$^2$ |
| Coupler C-6 | 0.005 g/m$^2$ |
| Coupler C-7 | 0.046 g/m$^2$ |
| Fifth Layer (Third Red-Sensitive Emulsion | |

-continued

| | |
|---|---|
| Layer): | |
| Silver iodobromide emulsion (silver iodide: 12 mol %; mean grain size: 2.2 μm) | 1.6 g/m$^2$ |
| Sensitizing Dye I | 5.5 × 10$^{-5}$ mol per mol of Ag |
| Sensitizing Dye II | 1.6 × 10$^{-5}$ mol per mol of Ag |
| Sensitizing Dye III | 2.2 × 10$^{-5}$ mol per mol of Ag |
| Sensitizing Dye IV | 1.6 × 10$^{-5}$ mol per mol of Ag |
| Coupler C-5 | 0.050 g/m$^2$ |
| Coupler C-7 | 0.15 g/m$^2$ |
| Sixth Layer (Intermediate Layer): | |
| A gelatin layer | |
| Seventh Layer (First Green-Sensitive Emulsion Layer): | |
| A gelatin layer containing; | |
| Silver iodobromide emulsion (silver iodide: 5 mol %; mean grain size: 0.5 μm) | 0.55 g/m$^2$ |
| Sensitizing Dye V | 3.8 × 10$^{-4}$ mol per mol of Ag |
| Sensitizing Dye VI | 3.0 × 10$^{-4}$ mol per mol of Ag |
| Sensitizing Dye VII | 1.2 × 10$^{-4}$ mol per mol of Ag |
| Coupler C-8 | 0.29 g/m$^2$ |
| Coupler C-9 | 0.040 g/m$^2$ |
| Coupler C-10 | 0.055 g/m$^2$ |
| Coupler C-11 | 0.058 g/m$^2$ |
| Eighth Layer (Second Green-Sensitive Emulsion Layer): | |
| A gelatin layer containing; | |
| Silver iodobromide emulsion (silver iodide: 6 mol %; mean grain size: 1.5 μm) | 1.5 g/m$^2$ |
| Sensitizing Dye V | 2.7 × 10$^{-4}$ mol per mol of Ag |
| Sensitizing Dye VI | 2.1 × 10$^{-5}$ mol per mol of Ag |
| Sensitizing Dye VII | 8.5 × 10$^{-5}$ mol per mol of Ag |
| Coupler C-8 | 0.25 g/m$^2$ |
| Coupler C-9 | 0.013 g/m$^2$ |
| Coupler C-10 | 0.009 g/m$^2$ |
| Coupler C-11 | 0.011 g/m$^2$ |
| Ninth Layer (Third Green-Sensitive Emulsion Layer): | |
| A gelatin layer containing; | |
| Silver iodobromide emulsion (silver iodide: 12 mol %; mean grain size: 2.2 μm) | 1.5 g/m$^2$ |

-continued

| | |
|---|---|
| Sensitizing Dye V | 3.0 × 10$^{-4}$ mol per mol of Ag |
| Sensitizing Dye VI | 2.4 × 10$^{-5}$ mol per mol of Ag |
| Sensitizing Dye VII | 9.5 × 10$^{-5}$ mol per mol of Ag |
| Coupler C-12 | 0.070 g/m$^2$ |
| Coupler C-11 | 0.002 g/m$^2$ |
| Coupler C-9 | 0.013 g/m$^2$ |
| Tenth Layer (Yellow Filter Layer): | |
| A gelatin layer containing; | |
| Yellow colloidal silver | 0.04 g/m$^2$ |
| 2,5-Di-t-pentadecylhydroquinone | 0.031 g/m$^2$ |
| Eleventh Layer (First Blue-Sensitive Emulsion Layer): | |
| A gelatin layer containing; | |
| Silver iodobromide emulsion (silver iodide: 6 mol %; mean grain size: 0.4 μm) | 0.32 g/m$^2$ |
| Coupler C-13 | 0.68 g/m$^2$ |
| Coupler C-14 | 0.030 g/m$^2$ |
| Twelfth Layer (Second Blue-Sensitive Emulsion Layer): | |
| A gelatin layer containing; | |
| Silver iodobromide emulsion (silver iodide: 10 mol %; mean grain size: 1.0 μm) | 0.40 g/m$^2$ |
| Coupler C-13 | 0.22 g/m$^2$ |
| Sensitizing Dye VIII | 2.2 × 10$^{-4}$ mol per mol of Ag |
| Thirteenth Layer (Third Blue-Sensitive Emulsion Layer): | |
| A gelatin layer containing; | |
| Silver iodobromide emulsion (silver iodide: 10 mol %; mean grain size: 2.3 μm) | 1.00 g/m$^2$ |
| Coupler C-13 | 0.19 g/m$^2$ |
| Sensitizing Dye VIII | 2.3 × 10$^{-4}$ mol per mol of Ag |
| Fourteenth Layer (First Protective layer): | |
| A gelatin layer containing; | |
| Ultraviolet absorbent C-1 | 0.14 g/m$^2$ |
| Ultraviolet absorbent C-2 | 0.22 g/m$^2$ |
| Fifteenth Layer (Second Protective Layer): | |
| A gelatin layer containing; | |
| Polymethyl methacrylate particles (diameter: 1.5 μm) | 0.05 g/m$^2$ |

To each of the foregoing layers were further added a gelatin hardening agent C-15 and a surface active agent in addition to the above components.

Compounds used for the preparation of Sample 101 are shown below.

Polymer having a repeating unit of the formula

C-1

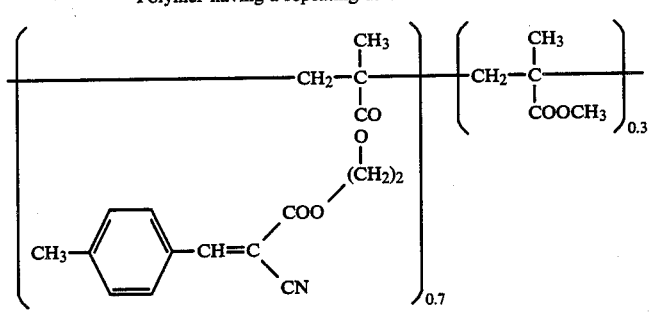

C-2

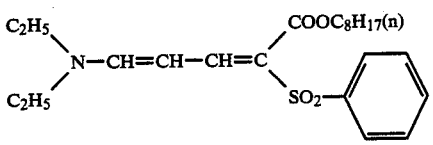

-continued
C-3
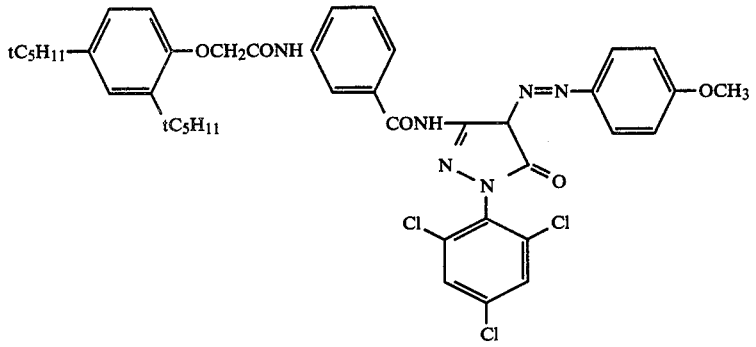
C-4
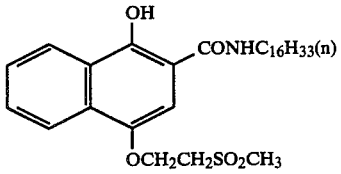
C-5
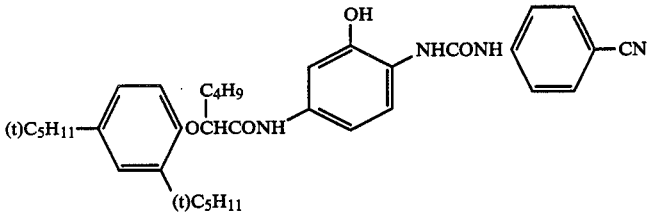
C-6
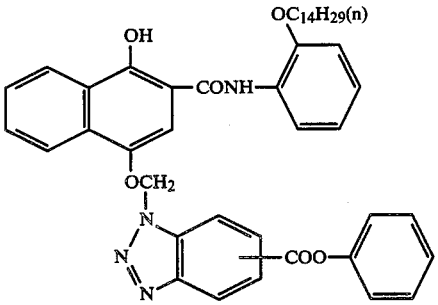
C-7
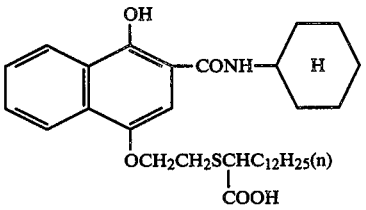
Polymer having a repeating unit of the formula
C-8
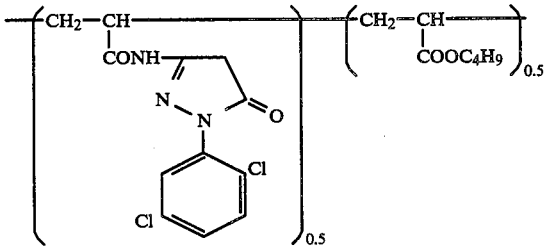

-continued
C-9
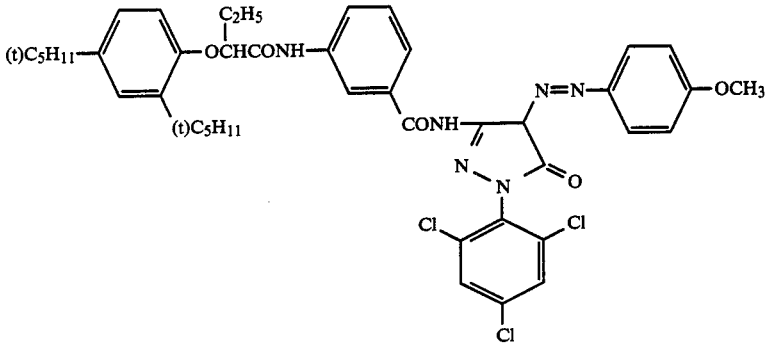
C-10
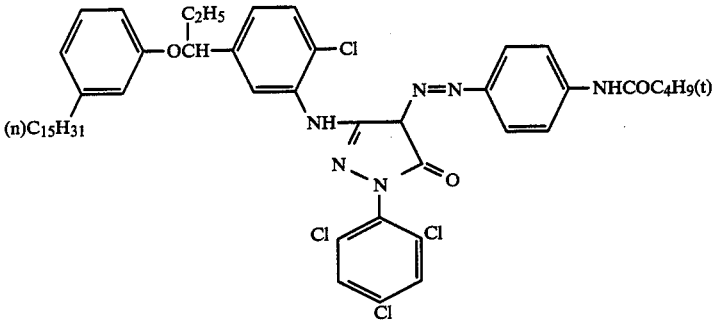
C-11
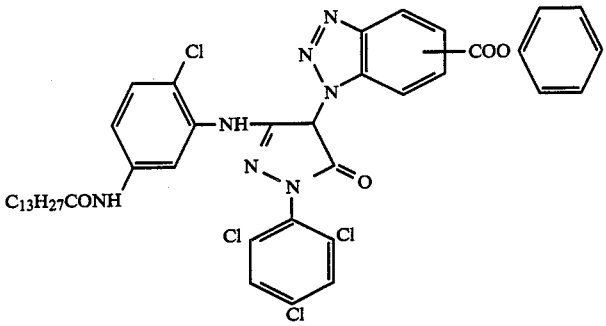
C-12
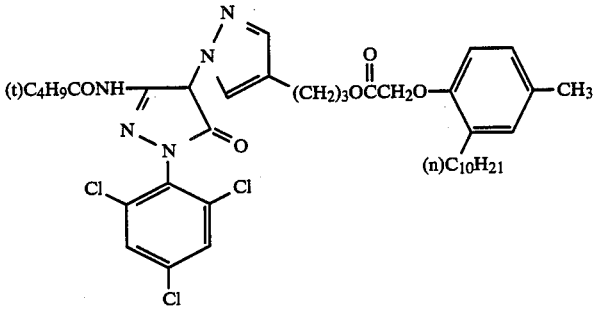

-continued
C-13
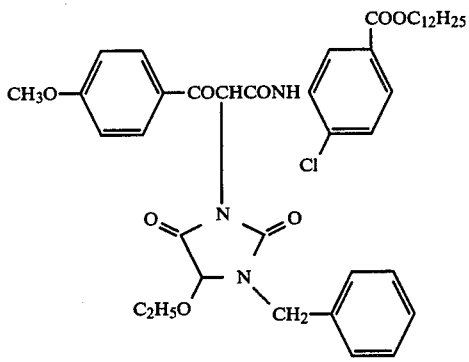
C-14
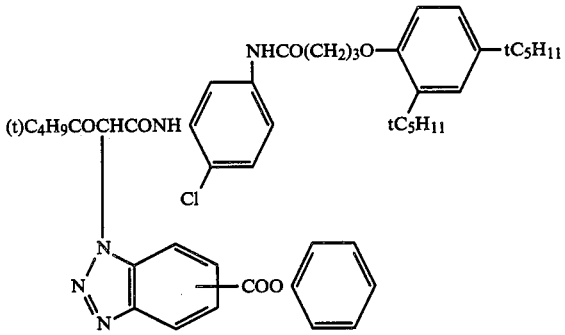
C-15
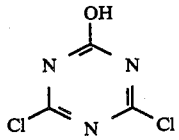
I
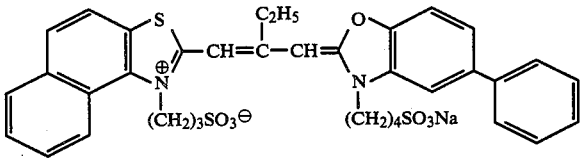
II
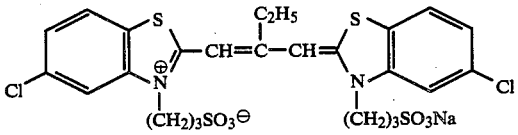
III
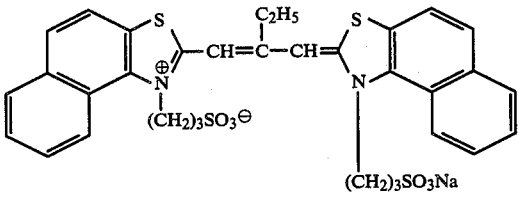
IV
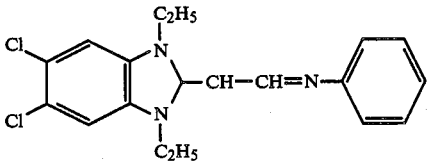

-continued

V

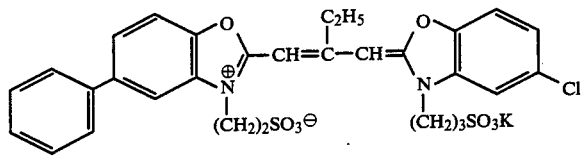

VI

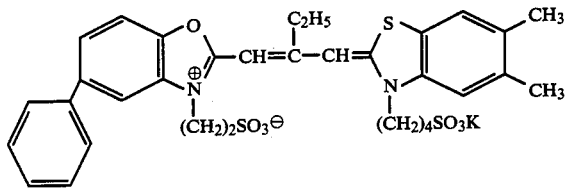

VII

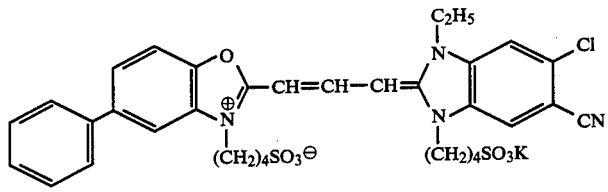

VIII

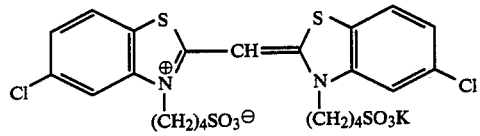

Samples 102 to 104

Samples 102, 103 and 104 were prepared in the same manner as described for Sample 101, except that FR-Releasing Compounds (I-1), (I-6), and (I-17), respectively, were added to the 5th layer in amounts of 0.1 $g/m^2$, 4 $mg/m^2$, and 5 $mg/m^2$, respectively.

Samples 105 to 108

Samples 105 to 108 were prepared in the same manner as for Samples 101 to 104, respectively, except that Silver Iodobromide Emulsion A having a mean grain size of 0.08 μm and a silver iodide content of 2 mol% which was prepared as follows was added to the 6th layer of Samples 101 to 104 in an amount of 0.3 $g/m^2$ as a silver coverage.

Preparation of Silver Iodobromide Emulsion A:

To 1,000 ml of a 2% aqueous solution of gelatin maintained at 40° C. with stirring were simultaneously added 800 ml of a 12.5% aqueous solution of silver nitrate and 800 ml of an aqueous solution containing 0.24% of potassium iodide and 8.58% of potassium bromide while maintaining the pAg value of the mixture at 7.7. There was obtained a non-developable silver halide emulsion having a mean grain size of 0.08 μm and a silver iodide content of 2 mol%.

Each of Samples 101 through 108 was imagewise exposed to white light and subjected to color development as described below thereby to obtain sensitivity as shown in Table 1.

Further, Sample 101 was uniformly exposed to green light and then imagewise exposed to red light to obtain a magenta image and a cyan image as shown in Figure.

In Figure, the curve A—B represents the characteristic curve of a cyan image formed in the red-sensitive layer, and the curve a—b represents the density of a magenta image formed in the green-sensitive layer by the uniform exposure to green light. Point A indicates the fog area of a dye image and Point B indicates an area of such an exposure amount to produce a cyan image density of 1.5. The difference between the magenta density a at Exposure A and the magenta density b at Exposure B, i.e., Δx, was taken as a criterion of interlayer effect from the red-sensitive layer (R) to the green-sensitive layer (G).

Each of Samples 102 through 108 was exposed and developed in the same manner as described above. The results obtained are shown in Table 1, wherein minus values of Δx (a—b) indicate that the density a at Exposure A was lower than the density b at Exposure B.

The development processing employed in this example was conducted as follows as 38° C.

Development Processing:

| | |
|---|---|
| 1. Color development | 3'15" |
| 2. Bleaching | 6'30" |
| 3. Rinsing | 3'15" |
| 4. Fixing | 6'30" |
| 5. Rinsing | 3'15" |
| 6. Stabilization | 3'15" |

The processing solution used in each step had the following formulation:

Color Developing Solution:

| | |
|---|---|
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methyl-aniline sulfate | 4.5 g |
| Water to make 1,000 ml | |

Bleaching Solution:

| | |
|---|---|
| Ammonium bromide | 160.0 g |
| Aqueous ammonia (28%) | 25.0 ml |
| Sodium (ethylenediaminetetra-acetato) ferrate | 130 g |
| Glacial acetic acid | 14 ml |
| Water to make 1,000 ml | |

Fixing Solution:

| | |
|---|---|
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make 1,000 ml | |

Stabilizing Solution:

| | |
|---|---|
| Formalin (27% formaldehyde solution) | 8.0 ml |
| Water to make 1,000 ml | |

TABLE 1

| Sample | Fine Silver Halide Grains in 6th Layer | FR-Compound in 5th Layer | Relative Sensitivity of Cyan Image | Interlayer Effect (Δx) |
|---|---|---|---|---|
| 101 | not added | — | 100 | 0.08 |
| 102 | not added | I-1 | 129 | −0.07 |
| 103 | not added | I-6 | 135 | −0.09 |
| 104 | not added | I-17 | 138 | −0.09 |
| 105 | added | — | 103 | 0.07 |
| 106 | added | I-1 | 132 | 0.08 |
| 107 | added | I-6 | 135 | 0.08 |
| 108 | added | I-17 | 138 | 0.07 |

As is apparent from Table 1, although Samples 102 to 104 wherein FR compounds were merely added had increased sensitivities, they showed negative interlayer effect from the red-sensitive layer onto the green-sensitive layer, resulting in serious color mixing. To the contrary, Samples 106 to 108 prepared in accordance with the present invention not only showed high sensitivities but also underwent no substantial color mixing.

While the invention has been described in detail and with reference to specific embodiments thereof, it will be apparent to those skilled in the art that various changes and modifications can be made therein without departing from the spirit and scope thereof.

What is claimed is:

1. A silver halide light-sensitive material comprising a support having provided thereon at least two silver halide emulsion layers differing in color sensitivity, at least one of said emulsion layers containing at least one compound capable of releasing a fogging agent, a development accelerator, or a precursor thereof in proportion to the amount of silver developed upon development processing, wherein a layer containing silver halide grains which are not substantially developed by the development processing of said light-sensitive material is provided between said two emulsion layers differing in color sensitivity.

2. A silver halide light-sensitive material as in claim 1, wherein the compound capable of releasing a fogging agent, a development accelerator, or a precursor thereof is represented by formula (1), (2), or (3):

$$\text{Cp—(TIME)}_n\text{—FA} \quad (1)$$

$$\text{BALL—Cp—(TIME)}_n\text{—FA} \quad (2)$$

$$\text{RED—(TIME)}_n\text{—FA} \quad (3)$$

wherein Cp represents a coupler residue capable of coupling with an oxidation product of an aromatic primary amine developing agent; BALL represents an anti-diffusible group releasable from Cp by a coupling reaction with an oxidation product of an aromatic primary amine developing agent; RED represents a compound residue capable of undergoing oxidation-reduction with an oxidation product of an aromatic primary amine developing agent; TIME represents a timing group releasable from Cp of RED upon a coupling reaction or oxidation-reduction reaction to release FA; n represents 0 or 1; and FA represents a residue containing a group capable of fogging silver halides or accelerating development or a precursor thereof and being releasable from Cp or RED upon coupling when n is 0, or releasable from TIME when n is 1.

3. A silver halide light-sensitive material as in claim 2, wherein FA is represented by the formula:

$$\text{AD—(L)}_m\text{—X}$$

wherein AD represents a group capable of being adsorbed onto silver halide grains; L represents a divalent group; m represents 0 or 1; and X represents a reducing group or a group capable of reacting with silver halides to form silver sulfide with proviso that when X is a group capable of reacting with silver halides to form silver sulfide; and also adsorbing onto silver halide grains, the group AD—(L)$_m$— is not necessarily required.

4. A silver halide light-sensitive material as in claim 2, wherein Cp is a yellow coupler residue represented by formula (I) or (II)

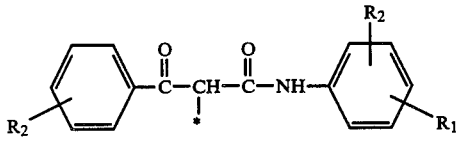

(I)

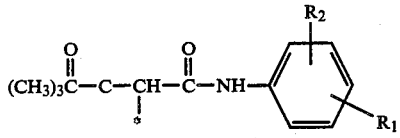

(II)

wherein $R_1$ represents an anti-diffusible group having from 8 to 32 total carbon atoms; $R_2$, which may be the same or different when $R_2$ represents two or more groups, represents a hydrogen atom or one or more of a halogen atom, a lower alkyl group, a lower alkoxy group and an anti-diffusible group having from 8 to 32 total carbon atoms; and the asterisk (*) indicates a position to which FA or TIME is bonded.

5. A silver halide light-sensitive material as in claim 2, wherein Cp is a magneta coupler residue represented by formula (III), (IV), or (V)

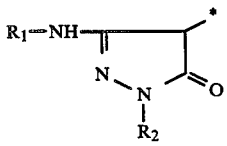

(III)

-continued (IV)

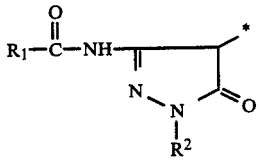

(V)

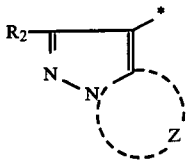

wherein $R_1$ represents an anti-diffusible group having from 8 to 32 total carbon atoms; $R_2$ represents a halogen atom, a lower alkyl group, a lower alkoxy group, a phenyl group or a substituted phenyl group; Z represents a non-metallic atomic group forming a substituted or unsubstituted 5-membered azole ring containing from 2 to 4 nitrogen atoms; and the asterisk (*) indicates a position to which FA or TIME is bonded.

6. A silver halide light-sensitive material as in claim 2, wherein Cp is a cyan coupler residue represented by formula (VI), (VII), (VIII), or (IX)

(VI)

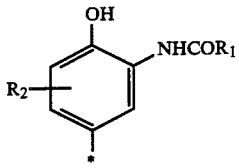

(VII)

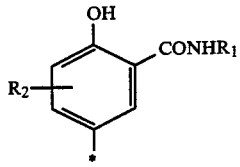

(VIII)

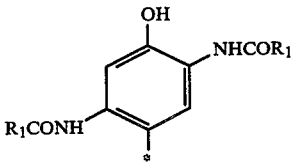

(IX)

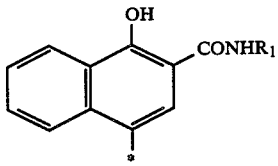

wherein $R_1$ represents an anti-diffusible group having from 8 to 32 total carbon atoms; $R_2$, which may be the same or different when $R_2$ represents two or more groups, represents one or more of a halogen atom, a lower alkyl group and a lower alkoxy group; and the asterisk (*) indicates a position to which FA or TIME is bonded.

7. A silver halide light-sensitive material as in claim 2, wherein Cp is a colorless coupler residue represented by formula (X), (XI), or (XII)

(X)

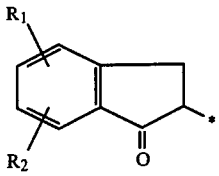

wherein $R_1$ represents an anti-diffusible group having from 8 to 32 total carbon atoms; $R_2$ represents a hydrogen atom, a halogen atom, a lower alkyl group or a lower alkoxy group; and the asterisk (*) indicates a position to which FA or TIME is bonded;

(XI)

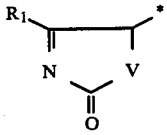

wherein $R_1$ represents an anti-diffusible group having from 8 to 32 total carbon atoms; V represents an oxygen atom, a sulfur atom, or a nitrogen atom; and the asterisk (*) is as defined above;

(XII)

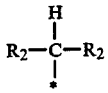

wherein $R_1$ and $R_2$ each represents an alkoxycarbonyl group, an aminocarbonyl group, an acyl group, a group derived from a sulfonic acid or sulfinic acid derivative corresponding to the above-described groups, a cyano group, an ammonium group or a nitrogen containing heterocyclic group which is bonded at the N-position thereof, or $R_1$ and $R_2$ may be taken together to form a 5- or 6-membered ring; and the asterisk (*) is as defined above.

8. A silver halide light-sensitive material as in claim 2, wherein Cp is a black forming coupler residue represented by formula (XIII), (XIV), or (XV)

(XIII)

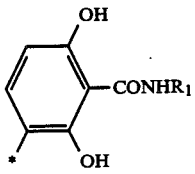

(XIV)

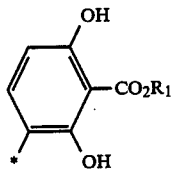

(XV)

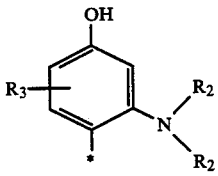

wherein $R_1$ represents an alkyl group having from 3 to 20 carbon atoms, a phenyl group, or a phenyl group substituted with a hydroxyl group, an amino group, or an alkyl or alkoxy group of from 1 to 20 carbon atoms; $R_2$, which may be the same or different, represents a hydrogen atom, a halogen atom, an alkyl or alkenyl group of from 1 to 20 carbon atoms or an aryl group of from 6 to 20 carbon atoms; $R_3$, which may be the same or different when $R_3$ represents two or more groups, represents one or more of a halogen atom, an alkyl or alkoxy group of from 1 to 20 carbon atoms and other monovalent groups; and the asterisk (*) indicates a position to which FA or TIME is bonded.

9. A silver halide light-sensitive material as claimed in claim 2, wherein FA is represented by formula (XII) or (XXIII)

(XXII)

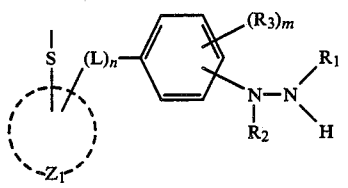

(XXIII)

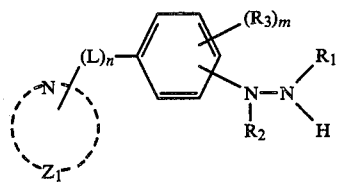

wherein $R_1$ represents an acyl group, a carbamoyl group, an alkylsulfonyl group, an arylsulfonyl group, an alkoxycarbonyl group, an aryloxycarbonyl group, or a sulfamoyl group; $R_2$ represents a hydrogen atom, an acyl group, or an aryloxycarbonyl group; $R_3$ represents a halogen atom, an alkoxy group, an alkyl group, an alkenyl group, an aryl group, an aryloxy group, an alkylthio group, an arylthio group, a carbonamido group, or a sulfonamido group; m represents 0 or an integer of from 1 to 4; when m is 2 of more, $R_3$ may be the same or different or two or more of them may be taken together to form a condensed ring; L is a divalent linking group; n represents 0 or 1; $Z_1$ represents a monocyclic or condensed hetero ring; and $Z_2$ represents an atomic group forming a monocyclic or condensed ring together with the adjacent nitrogen atom.

10. A silver halide light-sensitive material as in claim 1, wherein the compound capable of releasing a fogging agent, a development accelerator, or a precursor thereof is present in an amount of from $10^{-8}$ to 0.5 mols per mol of a silver halide light-sensitive emulsion in which said compound is incorporated.

11. A silver halide light-sensitive material as in claim 10, wherein the compound capable of releasing a fogging agent, a development accelerator, or a precursor thereof is present in an amount of from $5\times10^{-7}$ to $10^{-2}$ mols per mol of the silver halide light-sensitive emulsion in which said compound is incorporated.

12. A silver halide light-sensitive material as in claim 1, wherein the silver halide grains which are not substantially developed have a silver bromide content of 60 mol% or more, a silver chloride content of 30 mol% or less, and a silver iodide content of 40 mol% or less.

13. A silver halide light-sensitive material as in claim 12, wherein the silver halide grains which are not substantially developed are silver iodobromides having a silver iodide content of from 0 to about 20 mol%.

14. A silver halide light-sensitive material in claim 13, wherein the silver halide grains which are not substantially developed are silver iodobromides having a silver iodide content of from about 0.3 to about 5 mol%.

15. A silver halide light-sensitive material as in claim 1, wherein the silver halide grains which are not substantially developed have a mean grain size of about 0.2 μm or less.

16. A silver halide light-sensitive material as in claim 15, wherein the silver halide grains which are not substantially developed have a mean grain size of about 0.15 μm or less.

17. A silver halide light-sensitive material as in claim 16, wherein the silver halide grains which are not substantially developed have a mean grain size of 0.10 μm or less.

18. A silver halide light-sensitive material as in claim 1, wherein the layer containing the silver halide grains which are not substantially developed has a silver coverage of from 0.002 to 2 g/m$^2$.

19. A silver halide light-sensitive material as in claim 18, wherein the layer containing the silver halide grains which are not substantially developed has a silver coverage of from 0.01 to 1 g/m$^2$.

* * * * *